US012781453B2

(12) United States Patent
Adam et al.

(10) Patent No.: US 12,781,453 B2
(45) Date of Patent: Nov. 3, 2026

(54) CONTAINMENT PLOW

(71) Applicant: Douglas Dynamics, L.L.C., Milwaukee, WI (US)

(72) Inventors: Derek William Adam, Milwaukee, WI (US); Benjamin Chadwick Altfillisch, Milwaukee, WI (US); David N. Bloxdorf, Hubertus, WI (US); Christopher David Damon, Milwaukee, WI (US); Christopher Aaron Horn, Menomonee Falls, WI (US); Tyler David Gentz, Wauwatosa, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 501 days.

(21) Appl. No.: 18/360,337

(22) Filed: Jul. 27, 2023

(65) Prior Publication Data

US 2023/0407586 A1 Dec. 21, 2023

Related U.S. Application Data

(63) Continuation-in-part of application No. 18/053,885, filed on Nov. 9, 2022, which is a continuation-in-part (Continued)

(51) Int. Cl.
*E01H 5/06* (2006.01)

(52) U.S. Cl.
CPC ..... *E01H 5/067* (2013.01); *E01H 5/063* (2013.01)

(58) Field of Classification Search
CPC ..... E01H 5/061; E01H 5/062; E01H 5/063; E01H 5/065; E01H 5/066; E01H 5/067
See application file for complete search history.

(56) References Cited

U.S. PATENT DOCUMENTS 1,383,409 A 7/1921 Liddell
3,199,234 A 8/1965 Reissinger
(Continued)

FOREIGN PATENT DOCUMENTS

DE 3205974 A1 9/1983

OTHER PUBLICATIONS

2022 Horst Welding; HLA Snow _ Edge Flex.html, printed Aug. 30, 2023.

(Continued)

*Primary Examiner* — Joseph M Rocca
*Assistant Examiner* — Robert E Pezzuto
(74) *Attorney, Agent, or Firm* — Wood Herron & Evans LLP

(57) ABSTRACT

A containment plow adapted to be mounted to a vehicle comprises a moldboard frame, a moldboard mounted to the moldboard frame, a moldboard cutting edge mounted to a lower edge of the moldboard and comprising a plurality of cutting edge segments, and a moldboard extension and wing assembly connected to the moldboard frame adjacent each end of the moldboard. The assembly comprises an extension frame, a moldboard extension mounted to the extension frame, a wing connected to the extension frame at an outboard end of the moldboard extension, the moldboard extension having one of the cutting edge segments mounted to a lower edge of the moldboard extension, the moldboard extension cutting edge segment mounted so as to have two rotational degrees of freedom relative to the moldboard extension and one translational degree of freedom relative to the moldboard extension.

33 Claims, 38 Drawing Sheets

Related U.S. Application Data of application No. 17/806,835, filed on Jun. 14, 2022, now Pat. No. 12,497,744.

(56) References Cited

U.S. PATENT DOCUMENTS

| | | | | |
|---|---|---|---|---|
| 5,344,254 | A | | 9/1994 | Sartain |
| 5,375,349 | A | * | 12/1994 | Jochim ..... E01H 5/065 37/409 |
| 5,697,172 | A | | 12/1997 | Verseef |
| 5,819,443 | A | | 10/1998 | Winter |
| 6,823,615 | B2 | | 11/2004 | Strait |
| 7,089,692 | B2 | | 8/2006 | Strait |
| 7,107,709 | B2 | | 9/2006 | Hamel |
| 7,555,853 | B2 | | 7/2009 | Paonessa |
| 7,631,441 | B2 | | 12/2009 | Hunt |
| 7,658,022 | B2 | | 2/2010 | Strait |
| 7,975,409 | B2 | | 7/2011 | Paonessa |
| 8,776,405 | B2 | | 7/2014 | Paonessa |
| 9,051,700 | B2 | | 6/2015 | Summers et al. |
| 9,255,370 | B2 | | 2/2016 | Paonessa |
| 9,611,604 | B2 | | 4/2017 | Vigneault |
| 10,480,140 | B2 | | 11/2019 | Vigneault |
| 10,851,507 | B2 | | 12/2020 | Guggino et al. |
| 10,851,508 | B2 | | 12/2020 | Guggino et al. |
| 10,865,533 | B2 | | 12/2020 | Stephan |
| 10,865,534 | B2 | | 12/2020 | Martin et al. |
| 10,889,949 | B2 | | 1/2021 | Stephan |
| 11,203,852 | B2 | | 12/2021 | Vigneault |
| 2013/0025629 | A1 | | 1/2013 | Vigneault |
| 2019/0323204 | A1 | | 10/2019 | Vigneault |
| 2020/0018030 | A1 | | 1/2020 | Vigneault |
| 2021/0087764 | A1 | | 3/2021 | Guggino et al. |
| 2021/0285171 | A1 | | 9/2021 | Weihl |
| 2022/0081874 | A1 | | 3/2022 | Vigneault |
| 2022/0112674 | A1 | | 4/2022 | Strait et al. |

OTHER PUBLICATIONS

Nordik Blades; Nordik Move™ _Nordik Blades.html, printed Aug. 30, 2023.

2023 Kage Innovation; AdvantEdge.html, printed Aug. 30, 2023.

Mëtal Pless; Live Edge Snow Plow _ Mëtal Pleass.html, printed Aug. 30, 2023.

* cited by examiner

CONTAINMENT PLOW

RELATED APPLICATIONS

This application is a continuation-in-part of U.S. patent application Ser. No. 18/053,885 filed Nov. 9, 2022, which is a continuation-in-part of U.S. patent application Ser. No. 17/806,835 filed Jun. 14, 2022, all of which are hereby incorporated by reference herein as if fully set forth in their entirety.

FIELD OF THE INVENTION

This invention relates generally to plows, and more particularly to snow plows of the containment variety.

BACKGROUND OF THE INVENTION

Containment snow plows, also known as pusher plows or box plows, are typically mounted to equipment such as skid steers, wheeled loaders, or tractors. As such, containment plows are typically heavier duty than straight blade plows or V-blade plows that are mounted on pickup trucks, and are designed to push heavier snow loads.

A typical containment plow has a moldboard, a cutting edge mounted to a lower edge of the moldboard, a wing attached to each end of the moldboard, and a mounting frame for attaching the plow to the vehicle. On some containment plows, the wings are fixed relative to the moldboard and oriented forward and perpendicular thereto, thus providing the containment function. On other containment plows, the wings are pivoted relative to the moldboard, and may be oriented forward and perpendicular thereto, parallel thereto, or rearward and perpendicular thereto. When the wings are oriented rearward and perpendicular to the moldboard, the plow is configured to perform a back-dragging containment function.

Ideally a containment plow, or any plow for that matter, has the capability to accommodate obstructions and surface irregularities encountered during plowing. The ability to accommodate obstructions reduces damage to the plow, and the ability to accommodate surface irregularities reduces the number of passes the plow must make to completely clear the pavement of snow and ice. Obstructions may take the form of curbs, manhole covers, and the like. Surface irregularities may take the form of deviations in the pavement from true flat (i.e. dips or rises in the pavement) or deviations in the pavement from true horizontal.

While advancements in plow technology and in particular containment plow technology have been made to better accommodate obstructions and surface irregularities, nevertheless further improvement is desired.

SUMMARY OF THE INVENTION

In one aspect, a containment plow adapted to be mounted to a vehicle such as a skid steer, a wheeled loader, or a tractor comprises a moldboard frame, a moldboard mounted to the moldboard frame, a wing pivotally connected to the moldboard frame adjacent each end of the moldboard, a moldboard cutting edge mounted to a lower edge of the moldboard and comprising a plurality of cutting edge segments, and a wing cutting edge mounted to a lower edge of each wing. Each moldboard cutting edge segment is mounted so as to have two rotational degrees of freedom movement relative to the moldboard and one translational degree of freedom movement relative to the moldboard. Each wing cutting edge is mounted so as to have two rotational degrees of freedom movement relative to the wing.

Each moldboard cutting edge segment can be mounted to permit, independent of an adjacent segment, 1) pivoting movement about a first axis generally parallel to the lower edge of the moldboard, 2) pivoting movement about a second axis generally perpendicular to the lower edge of the moldboard, and 3) translational movement generally parallel to the lower edge of the moldboard, and each wing cutting edge can be mounted to permit 1) pivoting movement about a third axis generally parallel to the lower edge of the wing, and 2) pivoting movement about a fourth axis generally perpendicular to the lower edge of the wing.

Each moldboard cutting edge segment can be mounted to a respective moldboard cutting edge segment support plate. The support plate can be pivotally connected to the moldboard frame with a pivot pin, the pivot pin providing the pivoting movement of the segment about the first axis. Each end of the pivot pin can be positioned in a slot in a rib of the moldboard frame, the slots providing the translational movement of the segment generally parallel to the lower edge of the moldboard. The segment can be pivotally connected to the support plate with a fastener positioned medially of a length of the segment, the fastener providing the pivoting movement of the segment about the second axis.

A single biasing element can bias the segment forward relative to the lower edge of the moldboard about the first axis and downward relative to the lower edge of the moldboard.

The plow can further comprise a generally upwardly oriented link pivotally connected at a lower end to the support plate at a position aft of the pivot pin and slideably connected at an upper end to the moldboard frame. The biasing element can comprise a compression spring. The link can be positioned within the compression spring. An upper end of the compression spring can be captured against upward movement relative to the moldboard frame. Rearward pivoting movement of the segment about the first axis compresses the spring and develops a forward pivoting restoring torque, and upward translational movement of the segment develops a downward translational restoring force.

Each wing cutting edge can be mounted to a respective wing cutting edge support plate. The support plate can be pivotally connected to the wing with a first pin, the first pin providing the pivoting movement of the wing cutting edge about the third axis. The wing cutting edge can be pivotally connected to the support plate with a fastener positioned adjacent an end of the wing cutting edge nearest to the pivot connection of the wing to the moldboard frame, the fastener providing the pivoting movement of the wing cutting edge about the fourth axis.

A first biasing element can bias the wing cutting edge forward relative to the lower edge of the wing about the third axis, and a second biasing element can bias the wing cutting edge about the fourth axis so as to bias an end of the wing cutting edge furthest from the pivot connection of the wing to the moldboard frame downward relative to the lower edge of the wing.

The plow can further comprise a support plate bracket secured to a rear surface of the wing, pivot pin ears secured to the wing cutting edge support plate and to the support plate bracket, the ears pivotally receiving the first pin, the first biasing element comprising a first torsion spring encircling the first pin and having first and second legs, the first leg engaging the support plate and the second leg engaging the support plate bracket, a second pin secured to the support plate and extending generally parallel to the first pin, the second biasing element comprising a second torsion spring encircling the second pin and having first and second legs, the first leg engaging the wing cutting edge and the second leg engaging the support plate. Rearward pivoting movement of the wing cutting edge about the third axis twists the first torsion spring and develops a forward pivoting restoring torque, and upward pivoting movement of the end of the wing cutting edge furthest from the pivot connection of the wing to the moldboard frame twists the second torsion spring and develops a downward pivoting restoring torque.

The plow can further comprise an L-shaped bracket having a leg and a foot, the leg positioned against a rear surface of the support plate and the foot extending rearwardly therefrom, and a bar attached to the support plate, the support plate having a slot therein, a fastener securing the wing cutting edge to the L-shaped bracket, the fastener passing through the slot, the first leg of the second torsion spring engaging the foot of the L-shaped bracket and the second leg of the second torsion spring engaging the bar.

The wings can be pivoted to the moldboard frame so as to be positionable forward and perpendicular to the moldboard, parallel to the moldboard, and rearward and perpendicular to the moldboard.

In another aspect, a plow adapted to be mounted to a vehicle comprises a moldboard frame, a moldboard mounted to the moldboard frame, and a moldboard cutting edge mounted to a lower edge of the moldboard and comprising a plurality of cutting edge segments, each moldboard cutting edge segment mounted so as to have two rotational degrees of freedom movement relative to the moldboard and one translational degree of freedom movement relative to the moldboard.

In another aspect, a plow adapted to be mounted to a vehicle comprises a moldboard frame, a moldboard mounted to the moldboard frame, a wing pivotally connected to the moldboard frame adjacent each end of the moldboard, and a wing cutting edge mounted to a lower edge of each wing, each wing cutting edge mounted so as to have two rotational degrees of freedom movement relative to the wing.

In another aspect, a plow adapted to be mounted to a vehicle comprises a moldboard frame, a moldboard mounted to the moldboard frame, a wing pivotally connected to the moldboard frame adjacent each end of the moldboard, a wing cutting edge mounted to a lower edge of each wing, each wing cutting edge mounted to permit 1) pivoting movement about a first axis generally parallel to the lower edge of the wing, and 2) pivoting movement about a second axis generally perpendicular to the lower edge of the wing, each wing cutting edge mounted to a respective wing cutting edge support plate, the support plate pivotally connected to the wing with a pin, the pin providing the pivoting movement of the wing cutting edge about the first axis, and the wing cutting edge having inboard and outboard ends and being pivotally connected to the support plate between the ends with a first fastener, the first fastener providing the pivoting movement of the wing cutting edge about the second axis.

The wing cutting edge can be pivotally connected to the support plate midway between the ends. The plow can further comprise a biasing element biasing the wing cutting edge forward relative to the lower edge of the wing about the first axis, and the wing cutting edge pivoting freely about the second axis. The plow can further comprise a support plate bracket secured to a rear surface of the wing, pivot pin ears secured to the wing cutting edge support plate and to the support plate bracket, the ears pivotally receiving the pin, the biasing element comprising a torsion spring encircling the pin and having first and second legs, the first leg engaging the support plate and the second leg engaging the support plate bracket, whereupon rearward pivoting movement of the wing cutting edge about the first axis twists the first torsion spring and develops a forward pivoting restoring torque. The plow can further comprise a moldboard cutting edge mounted to a lower edge of the moldboard and comprising a plurality of cutting edge segments, each moldboard cutting edge segment mounted so as to have two rotational degrees of freedom movement relative to the moldboard and one translational degree of freedom movement relative to the moldboard. Each moldboard cutting edge segment can be mounted to permit, independent of an adjacent segment, 1) pivoting movement about a third axis generally parallel to the lower edge of the moldboard, 2) pivoting movement about a fourth axis generally perpendicular to the lower edge of the moldboard, and 3) translational movement generally parallel to the lower edge of the moldboard. A single biasing element can bias the segment forward relative to the lower edge of the moldboard about the third axis and downward relative to the lower edge of the moldboard. The plow can further comprise second and third fasteners, the first fastener passing through a first hole in the wing cutting edge and through a hole in the support plate, the second fastener passing through a second hole in the wing cutting edge at the outboard end thereof and through a first generally vertically oriented slot in the support plate, and the third fastener passing through a third hole in the wing cutting edge at the inboard end thereof and through a second generally vertically oriented slot in the support plate.

In another aspect, a plow comprises a moldboard frame, a moldboard mounted to the moldboard frame, a wing pivotally connected to the moldboard frame adjacent each end of the moldboard, a wing cutting edge mounted to a lower edge of each wing, each wing cutting edge mounted to permit 1) pivoting movement about a first axis generally parallel to the lower edge of the wing, and 2) pivoting movement about a second axis generally perpendicular to the lower edge of the wing, the wing cutting edge having inboard and outboard ends, the second axis located between the ends.

The second axis can be located midway between the ends. The plow can further comprise first, second, and third fasteners, the first fastener passing through a first hole in the wing cutting edge and through a hole in the wing, the second fastener passing through a second hole in the wing cutting edge at the outboard end thereof and through a first generally vertically oriented slot in the wing, and the third fastener passing through a third hole in the wing cutting edge at the inboard end thereof and through a second generally vertically oriented slot in the wing. The plow can further comprise a moldboard cutting edge mounted to a lower edge of the moldboard and comprising a plurality of cutting edge segments, each moldboard cutting edge segment mounted so as to have two rotational degrees of freedom movement relative to the moldboard and one translational degree of freedom movement relative to the moldboard. Each moldboard cutting edge segment can be mounted to permit, independent of an adjacent segment, 1) pivoting movement about a third axis generally parallel to the lower edge of the moldboard, 2) pivoting movement about a fourth axis generally perpendicular to the lower edge of the moldboard, and 3) translational movement generally parallel to the lower edge of the moldboard. The fasteners can be bolts, and the plow can further comprise first and second bushings, the first bushing riding in the first slot and the second bushing riding in the second slot, the bolts passing through the bushings.

The plow can further comprise a third bushing positioned in the hole in the wing, the bolt passing through the third bushing.

In another aspect, a containment plow adapted to be mounted to a vehicle such as a skid steer, a wheeled loader, or a tractor, comprises a moldboard frame, a moldboard mounted to the moldboard frame, a moldboard cutting edge mounted to a lower edge of the moldboard and comprising a plurality of cutting edge segments, each moldboard cutting edge segment mounted so as to have two rotational degrees of freedom movement relative to the moldboard and one translational degree of freedom movement relative to the moldboard, and a moldboard extension and wing assembly connected to the moldboard frame adjacent each end of the moldboard. The assembly comprises an extension frame, a moldboard extension mounted to the extension frame, a wing connected to the extension frame at an outboard end of the moldboard extension, the moldboard extension having one of the cutting edge segments mounted to a lower edge of the moldboard extension, the moldboard extension cutting edge segment mounted so as to have two rotational degrees of freedom movement relative to the moldboard extension and one translational degree of freedom movement relative to the moldboard extension.

Each moldboard cutting edge segment can mounted to permit, independent of an adjacent segment, 1) pivoting movement about a first axis generally parallel to the lower edge of the moldboard, 2) pivoting movement about a second axis generally perpendicular to the lower edge of the moldboard, and 3) translational movement generally parallel to the lower edge of the moldboard. Each moldboard extension cutting edge segment can be mounted to permit 1) pivoting movement about the first axis generally parallel to the lower edge of the moldboard, 2) pivoting movement about the second axis generally perpendicular to the lower edge of the moldboard, and 3) translational movement generally parallel to the lower edge of the moldboard.

Each said cutting edge segment can be mounted to a respective cutting edge segment support plate, the support plate pivotally connected to the moldboard frame or the extension frame with a pivot pin, the pivot pin providing the pivoting movement of the segment about the first axis, each end of the pivot pin positioned in a slot in a rib of the moldboard frame or the extension frame, the slots providing the translational movement of the segment generally parallel to the lower edge of the moldboard, and each cutting edge segment can be pivotally connected to the support plate with a fastener positioned medially of a length of the segment, the fastener providing the pivoting movement of the segment about the second axis.

A single biasing element can bias the segment forward relative to the lower edge of the moldboard about the first axis and downward relative to the lower edge of the moldboard.

The moldboard can have a width of about 10 feet or about 12 feet, and the extension wing assembly can have a width of about 2 feet.

The wing can be pivotally connected to the extension frame.

The wing can be fixedly connected to the extension frame, generally perpendicular to the moldboard extension, and have a shoe movably mounted to a lower edge thereof. The shoe can be mounted to permit 1) vertical translational movement in a plane defined by the wing, and 2) pivoting movement about an axis generally perpendicular to the plane defined by the wing.

The shoe can be spring biased to a downward position.

The shoe can be generally L-shaped in cross-section having a leg portion and a foot portion, and wherein the leg portion is mounted to the wing and the foot portion is a runner having an upturned forward end and an upturned rearward end. The leg portion can include a forward opening, a rearward opening, and a middle opening, and a fastener passing through each opening and secured to the wing. The forward and rearward openings can be generally vertically oriented arcuate slots, and the middle opening can be a generally vertically oriented upper slot and a generally horizontally oriented lower arcuate slot. The fastener that passes through the middle opening can be an upper fastener, the upper fastener passing through the upper slot. A lower fastener can pass through the lower slot. The upper and lower slots and upper and lower fasteners permit vertical translational movement and pivoting movement of the shoe within limits.

In another aspect, a moldboard extension and wing assembly adapted to be connected to an end of a moldboard frame of a containment plow, the containment plow adapted to be mounted to a vehicle such as a skid steer, a wheeled loader, or a tractor, comprises an extension frame, a moldboard extension mounted to the extension frame, a wing connected to one end of the extension frame, the moldboard extension having a cutting edge segment mounted to a lower edge of the moldboard extension, the cutting edge segment mounted so as to have two rotational degrees of freedom movement relative to the moldboard extension and one translational degree of freedom movement relative to the moldboard extension.

In another aspect, a moldboard extension and wing assembly adapted to be connected to an end of a moldboard frame of a containment plow, the containment plow adapted to be mounted to a vehicle such as a skid steer, a wheeled loader, or a tractor, comprises an extension frame, a moldboard extension mounted to the extension frame, a wing fixedly connected to one end of the extension frame and generally perpendicular to the moldboard extension, the moldboard extension having a cutting edge segment mounted to a lower edge of the moldboard extension, a shoe movably mounted to a lower edge of the wing to permit 1) vertical translational movement in a plane defined by the wing, and 2) pivoting movement about an axis generally perpendicular to the plane defined by the wing.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
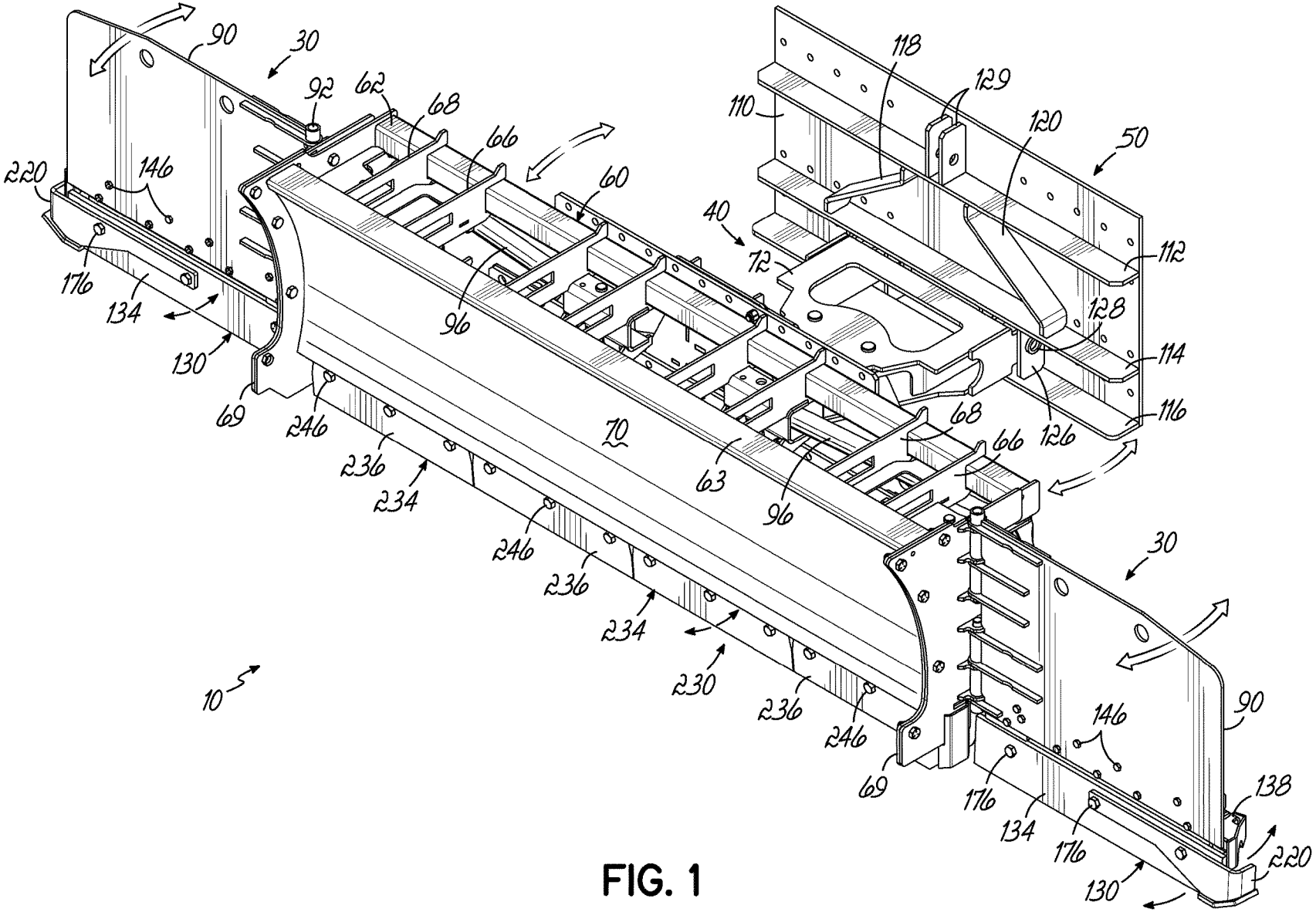
FIG. 1 is a front, left, top perspective view of a plow according to the principles of the present invention.
Figure 2:
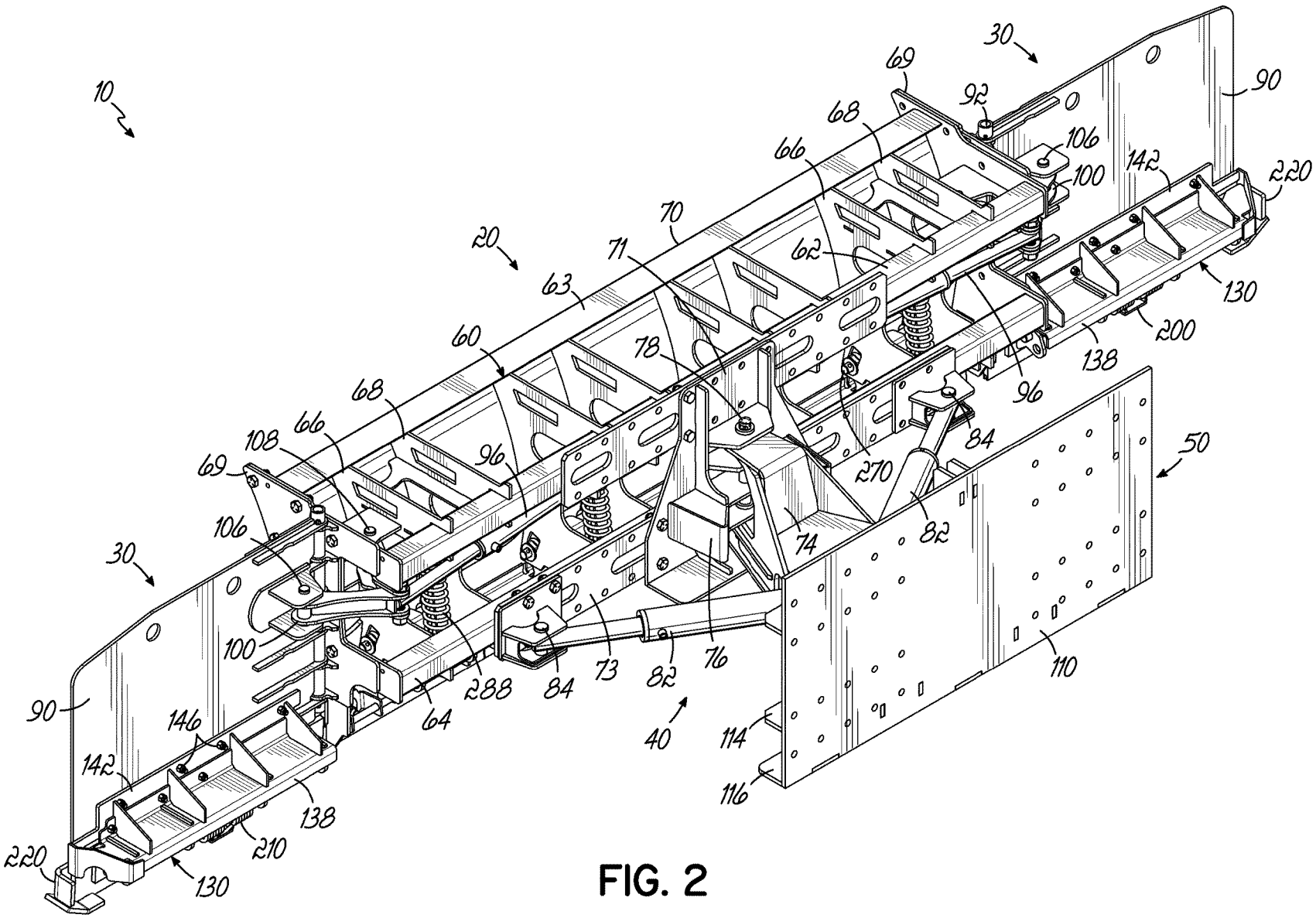
FIG. 2 is a rear, left, top perspective view thereof.
Figure 3:
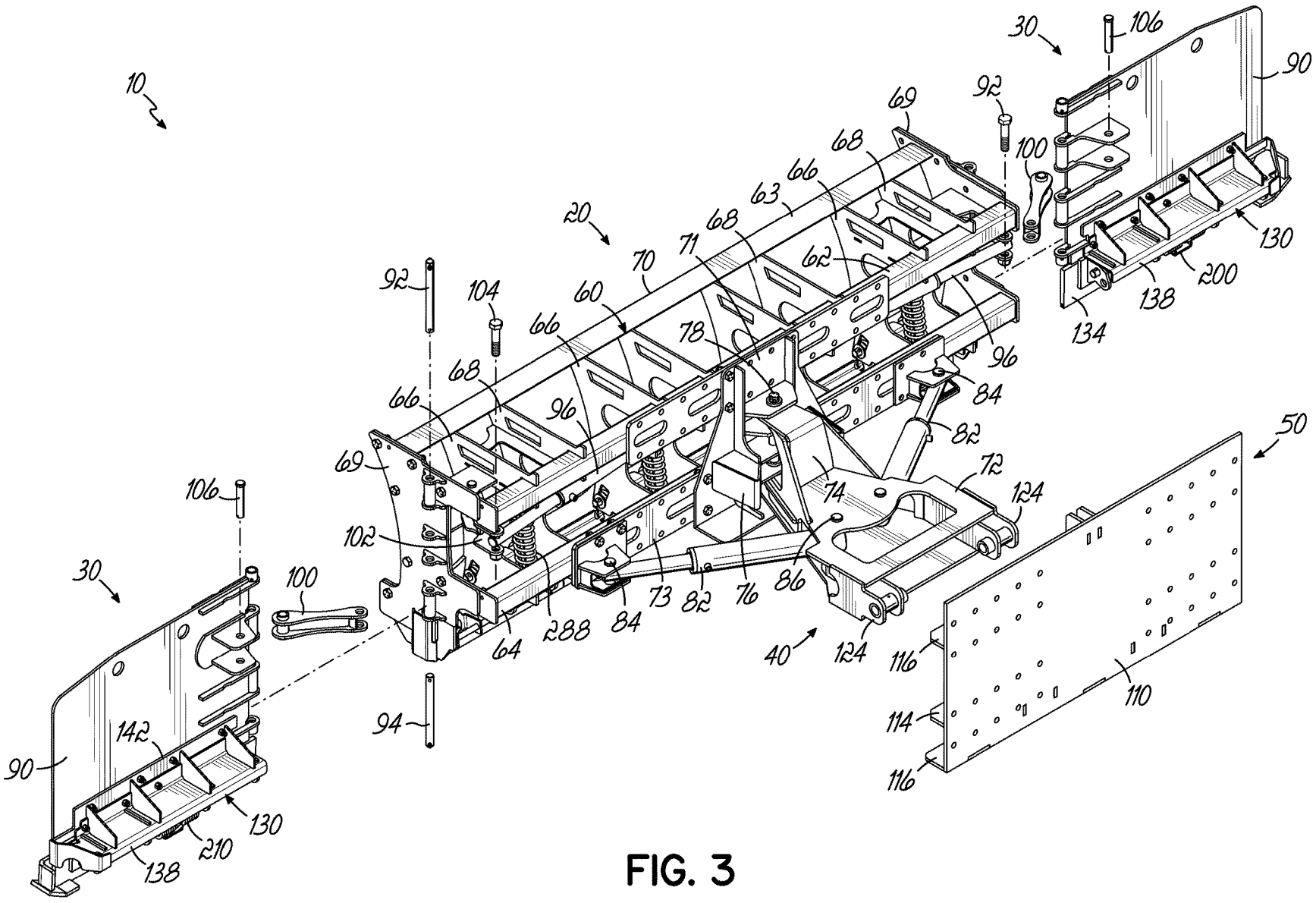
FIG. 3 is a rear, left, top, exploded perspective view thereof.
Figure 4:
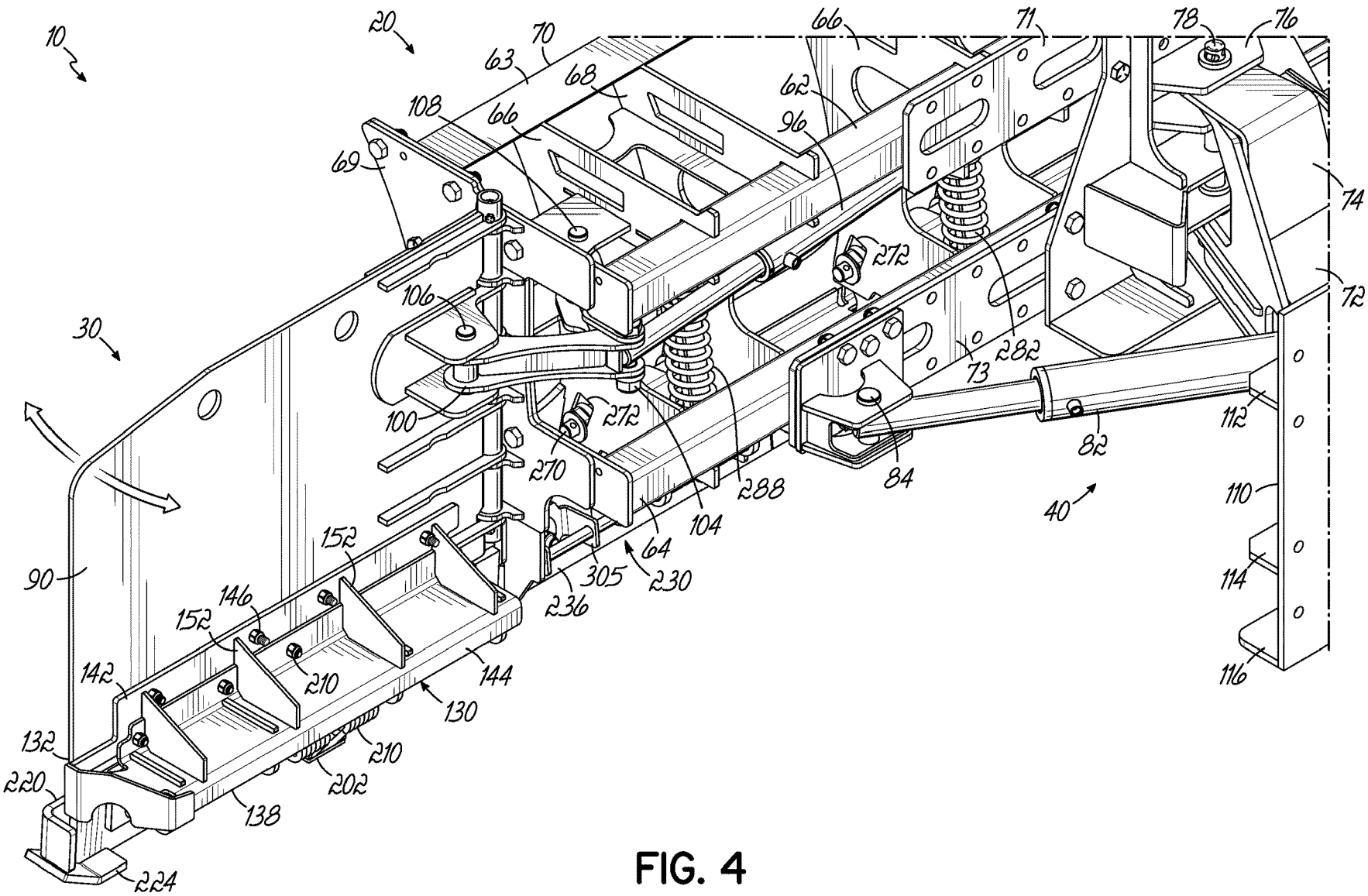
FIG. 4 is an enlarged, rear, left, top perspective view of the left hand end of the plow.
Figure 5:
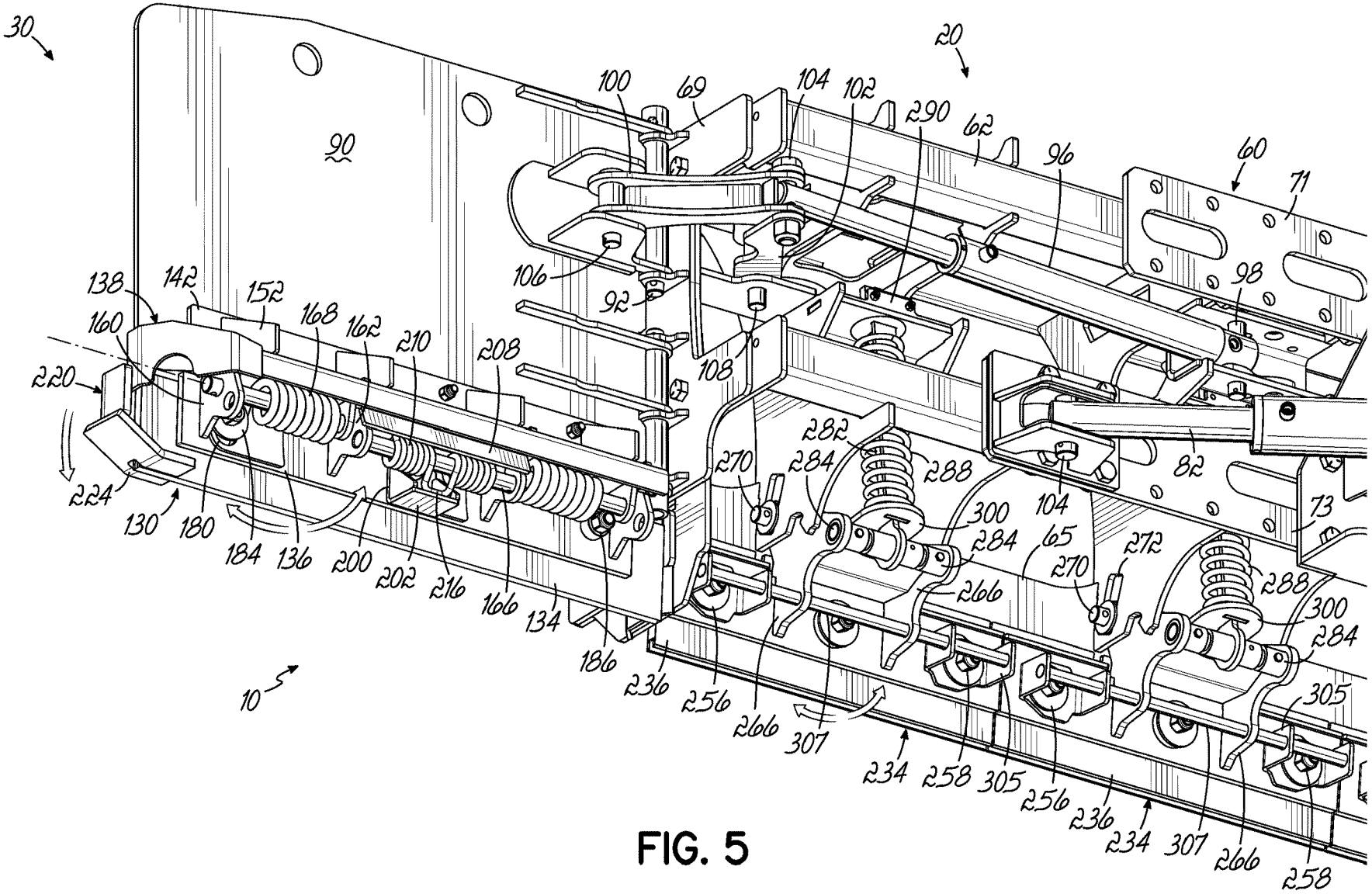
FIG. 5 is an enlarged, rear, left, bottom perspective view of the left hand end of the plow.
Figure 6:
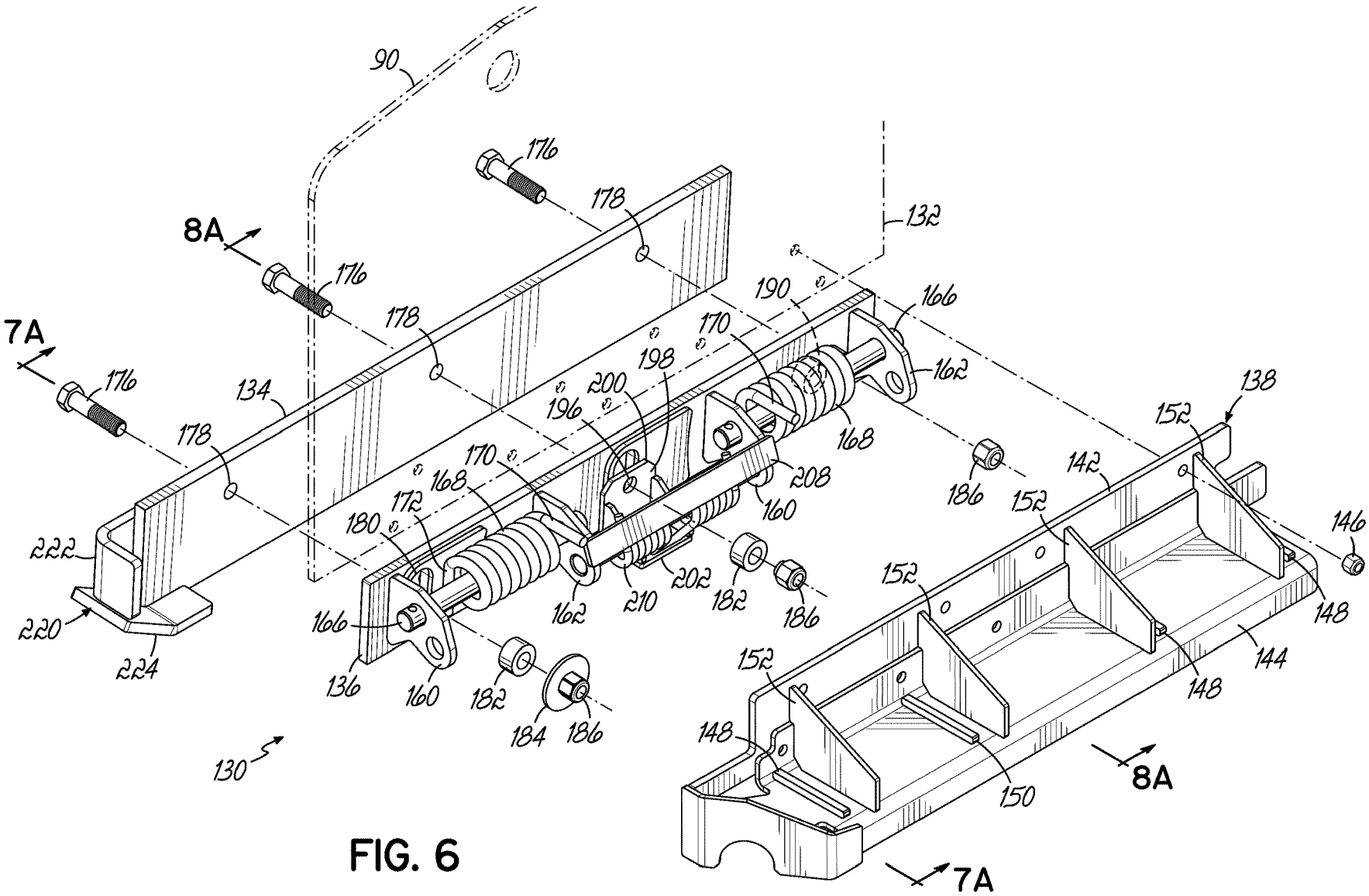
FIG. 6 is a rear, left, top, exploded perspective view of the left hand wing cutting edge.

Referring first to FIGS. 1-3, a plow assembly 10 according to the principles of the present invention is illustrated. Plow assembly 10 includes a main or central plow assembly 20, a pair of plow wing assemblies 30, a plow support frame assembly 40, and a plow mounting plate assembly 50. While the main or central plow assembly 20 is illustrated as being much wider than each plow wing assembly 30, it is to be understood that the plow assembly 10 can also be configured into essentially a V-blade plow wherein each wing assembly 30 is much wider than the main or central plow assembly 20.

The main or central plow assembly 20 includes a moldboard frame 60 having upper 62 and lower 64 generally transverse, generally horizontal frame members. A plurality of pairs of generally vertical ribs or plates 66, 68 are secured to frame members 62, 64. A pair of end plates 69 are likewise secured to frame members 62, 64. A top plate 63 and bottom plate 65 are secured to the ribs 66, 68. A moldboard 70 is secured to the ribs 66, 68, the end plates 69, and the top and bottom plates 63, 65.

The plow support frame assembly 40 includes a generally A-shaped frame 72 having a female clevis plate 74 at a forward end thereof. Moldboard frame 60 has upper and lower bolting plates 71, 73, each including an array of bolt holes, secured to upper 62 and lower 64 frame members, respectively. A cooperating male clevis plate 76 is bolted to the bolting plates 71, 75. A pivot pin 78 pivotally connects the clevis connection 74, 76 for pivoting movement of main or central plow assembly 20 relative to plow support frame assembly 40 about a generally vertical axis. A pair of hydraulic rams 82 have piston ends pivotally connected to lower bolting plate 73 at 84 and cylinder ends pivotally connected to A-frame 72 at 86. Rams 82 providing pivoting movement of main or central plow assembly 20 relative to plow support frame assembly about the generally vertical pivot axis. See FIG. 15D.

Figure 15A:
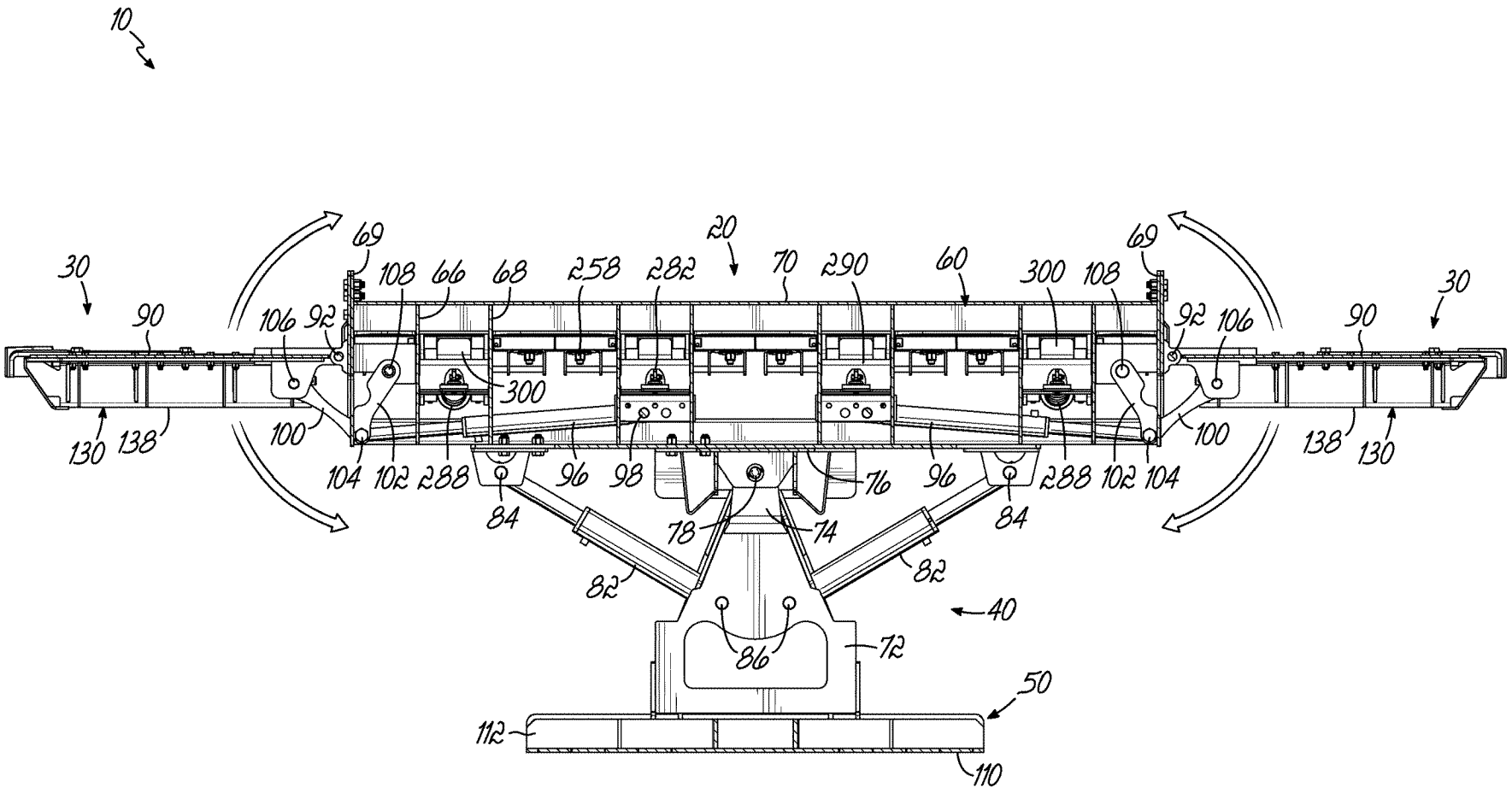
FIG. 15A is a top view of the plow with wings parallel to the moldboard.
Figure 15B:
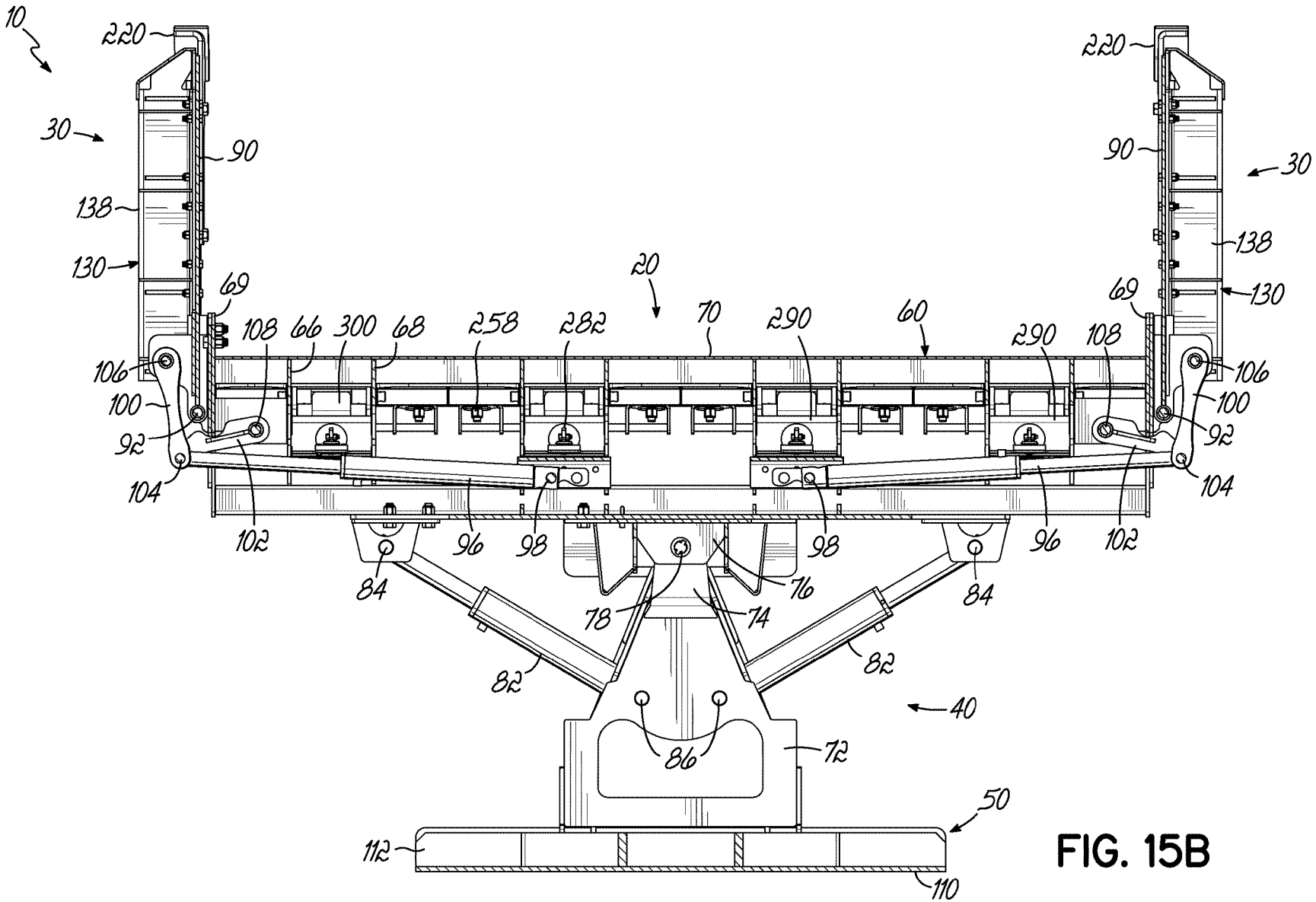
FIG. 15B is a top view of the plow with wings forward and perpendicular to the moldboard.
Figure 15C:
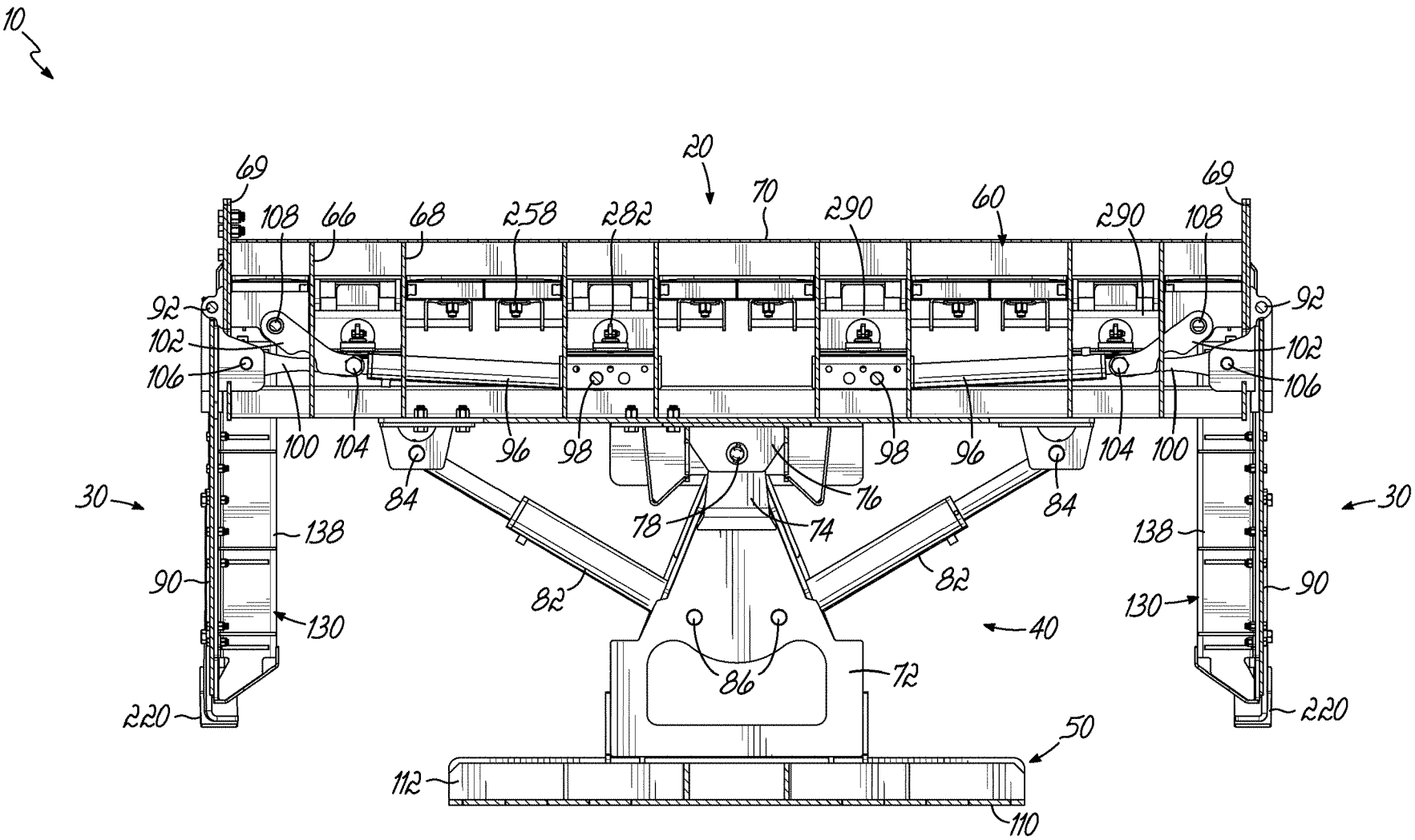
FIG. 15C is a top view of the plow with wings rearward and perpendicular to the moldboard.
Figure 15D:
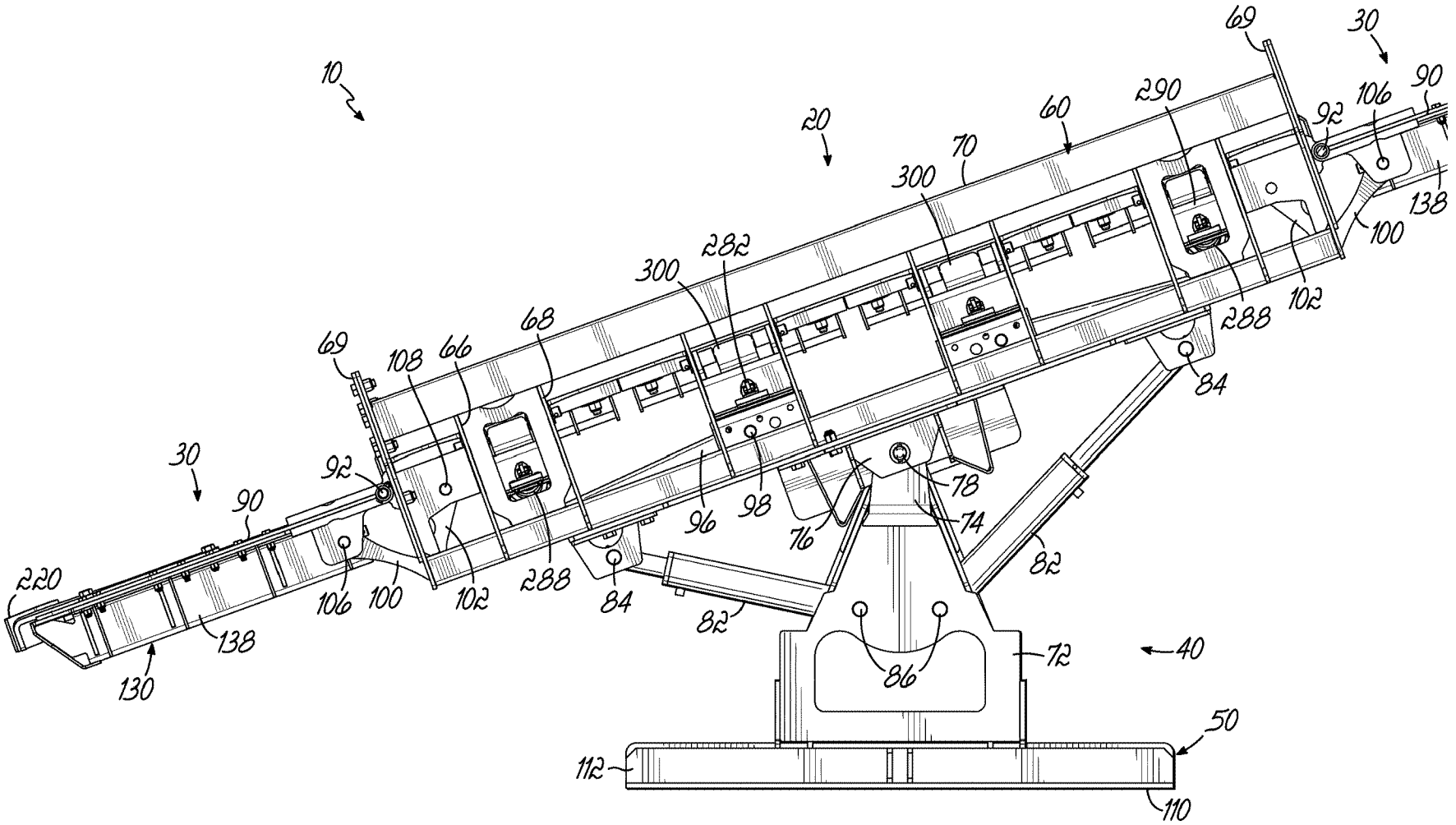
FIG. 15D is a top view of the plow with wings parallel to the moldboard and the moldboard angled to the left.
Figure 16:
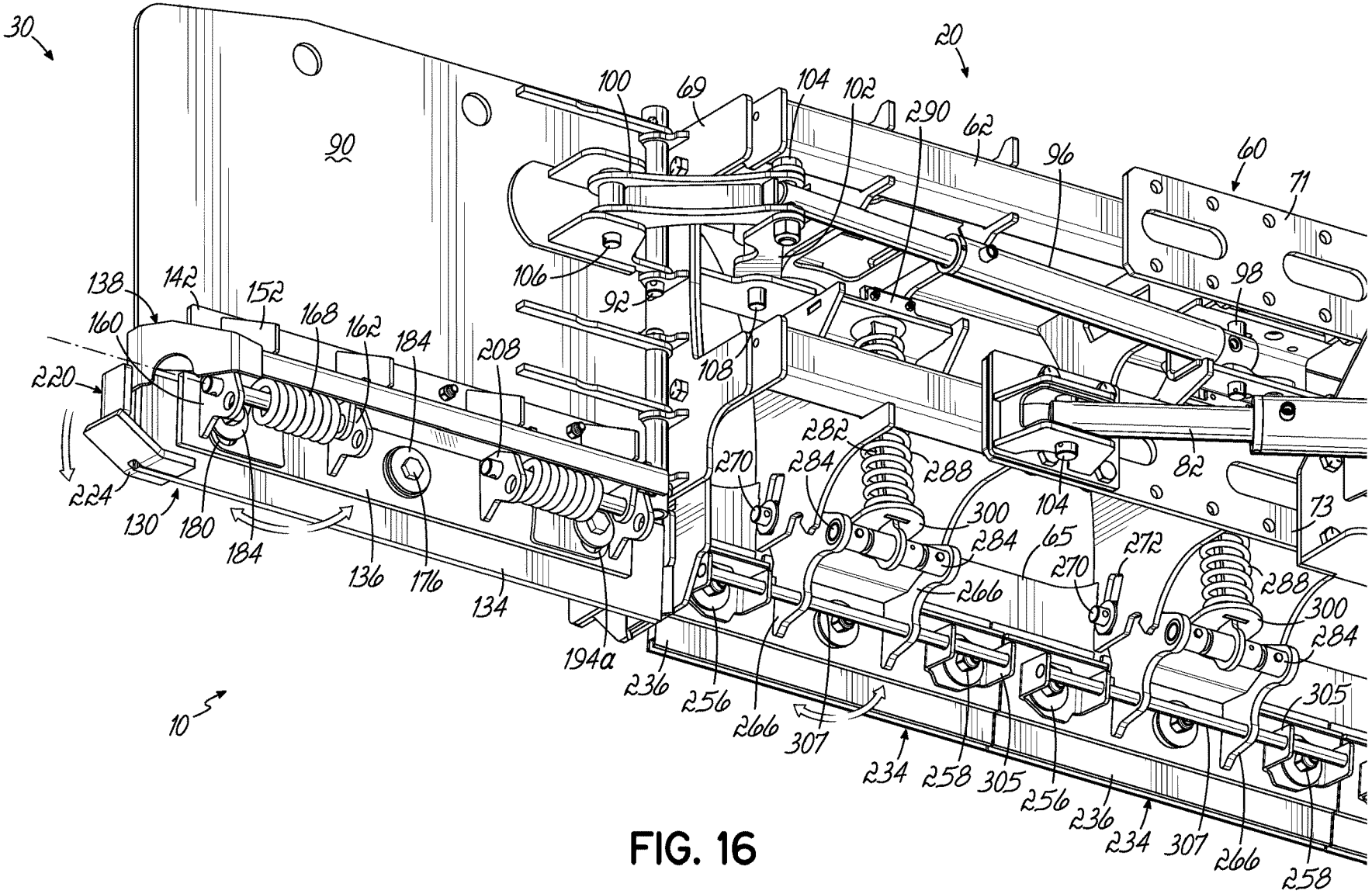
FIG. 16 is an enlarged, rear, left, bottom perspective view of the left hand end of an alternative embodiment of the plow.
Figure 17:
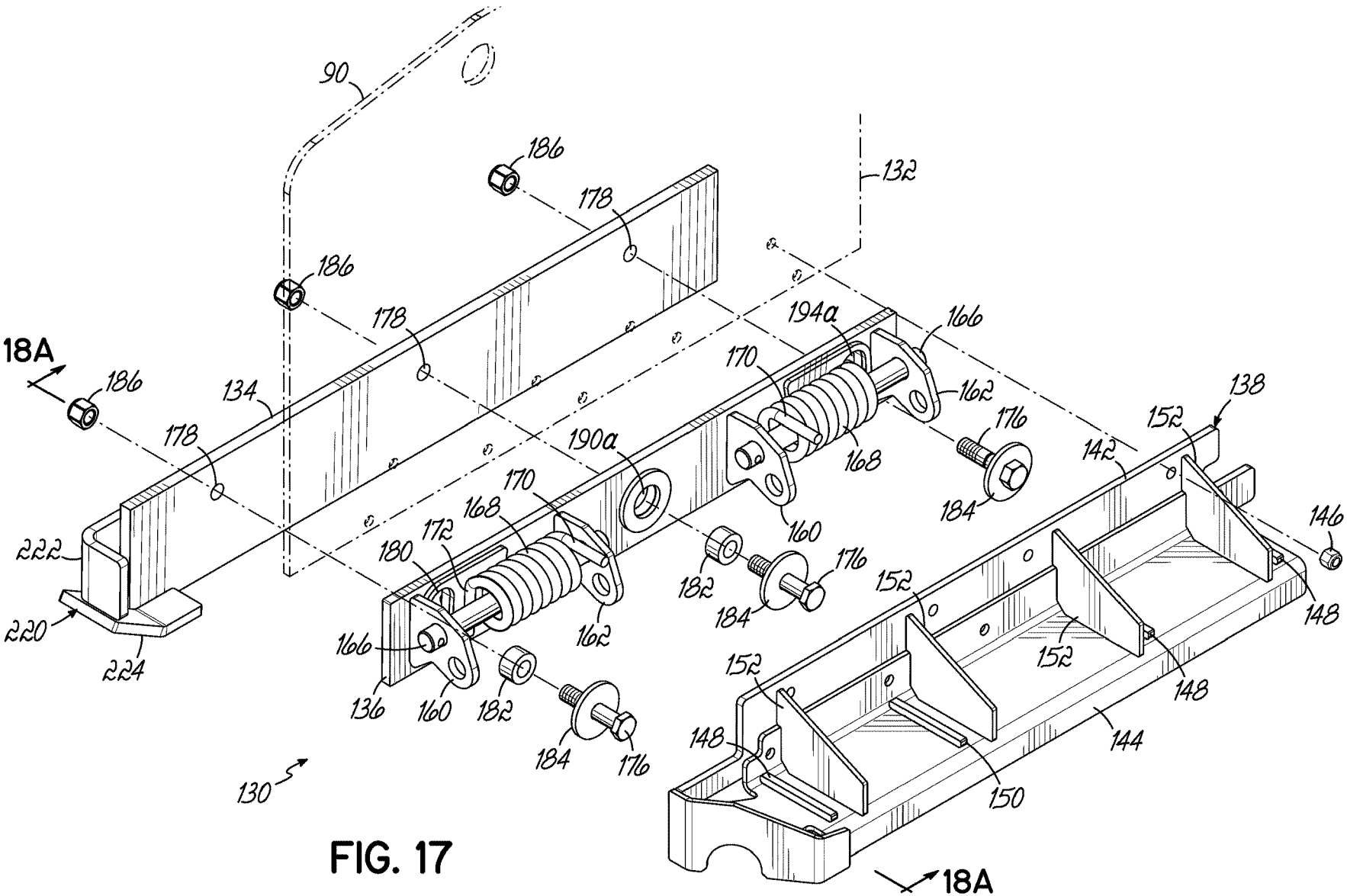
FIG. 17 is a rear, left, top, exploded perspective view thereof.

Referring to FIGS. 1-5 and 15A-15C, each plow wing assembly 30 includes a wing 90 pivotally connected to its respective moldboard frame end plate 69 with pins 92, 94. A hydraulic ram 96 has a cylinder end pivotally connected to the moldboard frame at 98. The piston end of ram 96 is pivotally connected to a pair of links 100, 102 at 104. Link 100 is pivotally connected to wing 90 at 106, and link 102 is pivotally connected to moldboard frame 60 at 108. Rams 96 providing pivoting movement of wings 90 relative to moldboard frame 60 so as to be positionable forward and perpendicular to the moldboard 70 (FIG. 15B), parallel to the moldboard 70 (FIG. 15A), and rearward and perpendicular to the moldboard 70 (FIG. 15C).

Plow mounting plate assembly 50 has a rectangular plate 110 with a plurality of transverse reinforcement plates 112, 114, 116 secured thereto. Diagonal interconnecting reinforcement plates 118, 120 interconnect plates 112, 114. Plates 114, 116 are spaced apart so as to closely receive therebetween the rearward ends 124 of A-frame 72. The rearward ends 124 of A-frame 72 can be secured to lower vertical plates 126 between transverse plates 114, 116 with fasteners 128 such as bolts and nuts, pins, or the like. Upper vertical plates 129 provide a third attachment point of plow support frame assembly 40 to plow mounting plate assembly 50. Rectangular plate 110 is adapted to be mounted to a skid steer loader, wheeled loader, or tractor in place of the customary bucket, as is known to those skilled in the art. Lift arms on the skid steer loader, wheeled loader, or tractor raise and lower rectangular plate 110 thus raising and lowering the entire plow assembly 10.

Alternatively, plow support frame assembly 40 and plow mounting plate assembly 50 can be done away with, and moldboard frame 60, via bolting plates 71, 73, can be mounted to the lift arms of the skid steer loader, wheeled loader, or tractor via a suitable intermediate adapter/mounting plate, which could include a slip hitch or the like.

Referring to FIGS. 4-9B, wing 90 includes a wing cutting edge assembly 130 mounted to a lower edge or edge region 132 of wing 90. Wing cutting edge assembly 130 includes a cutting edge 134, a cutting edge support plate 136, and a cutting edge support plate bracket 138. Bracket 138 is generally L-shaped in cross-section having a leg portion 142 and a foot portion 144. Leg portion 142 is secured to a rear surface of wing 90 with fasteners 146, for example bolts and nuts. Foot portion 144 has, depending therefrom, an outboard pair 148, 150 of pivot pin mounting ears and an inboard pair 148, 150 of pivot pin mounting ears. Gusset plates 152 interconnect the leg and foot portions 142, 144.

Support plate 136 has, extending rearward therefrom, an outboard pair 160, 162 of pivot pin mounting ears and an inboard pair 160, 162 of pivot pin mounting ears. Each support plate ear pair 160, 162 and corresponding bracket ear pair 148, 150 are pivotally connected via a pivot pin 166. A torsion spring 168 encircles each pin 166. Each torsion spring 168 has a one leg 170 engaging an underneath surface of foot portion 144 of bracket 138 and another leg 172 engaging a rearward surface of support plate 136. Support plate 136 and hence cutting edge 134 are thus pivotally connected to bracket 138 and hence wing 90 for pivoting movement about an axis generally parallel to the lower edge or edge region 132 of wing 90 (i.e., a generally horizontal, generally transverse axis (transverse to longitudinal axis of vehicle) when wing 90 is positioned parallel to moldboard 70 and moldboard 70 is positioned facing forward as shown in FIG. 15A), as well as being biased forward relative to the lower edge or edge region 132 of wing 90. Wing cutting edge assembly 130 is preferably configured to permit about 42.7 degrees of rearward pivoting movement of wing cutting edge 134.

Cutting edge 134 is secured to support plate 136 with three fasteners 176, for example bolts. The outboard most bolt 176 passes through a hole 178 in the cutting edge 134 and through a generally vertical slot 180 in the support plate 136, i.e. the longitudinal axis of slot 180 is generally perpendicular to the longitudinal axis of support plate 136. This bolt 176 passes through a bushing 182 positioned in slot 180 and through a washer 184 positioned against a rearward surface of the support plate 136. A nut 186 on this bolt 176 secures the cutting edge 134, support plate 136, bushing 182, and washer 174 together.

The inboard most bolt 176 passes through a hole 178 in the cutting edge 134 and through a hole 190 in the support plate 136. A nut 186 on this bolt 176 secures the cutting edge 134 and support plate 136 together.

The third bolt 176 is positioned medially of the outboard most and inboard most bolts 176 and passes through a hole 178 in the cutting edge 134 and through a generally vertical slot 194 in the support plate 136, i.e. the longitudinal axis of slot 194 is generally perpendicular to the longitudinal axis of support plate 136. This bolt 176 passes through a bushing 182 positioned in slot 194 and through a hole 196 in a leg portion 198 of an L-shaped bracket 200. A nut 186 on this bolt 176 secures the cutting edge 134, support plate 136, bushing 182, and L-shaped bracket 200 together.

L-shaped bracket 200 has a foot portion 202 extending rearward from leg portion 198. The outboard most one of the ears 162 on support plate 136 and the inboard most one of the ears 160 on the support plate 136 support a pin or rod 206. A bar 208 spans between and is secured to these ears. A torsion spring 210 encircles pin 206. The torsion spring 210 has two end legs 214 engaging a forward surface of bar 208 and a central U-shaped leg 216 engaging an upper surface of foot portion 202 of bracket 200. Cutting edge 134 is thus pivotally connected to support plate 136 and hence wing 90 for pivoting movement about an axis generally perpendicular to the lower edge or edge region 132 of wing 90 (i.e., a generally horizontal, generally longitudinal axis (parallel to longitudinal axis of vehicle) when wing 90 is positioned parallel to moldboard 70 and moldboard 70 is positioned facing forward as shown in FIG. 15A), as well as being biased about this axis so as to bias the outboard most end of the cutting edge 134 downward relative to the lower edge or edge region 132 of wing 90. Slots 180 and 194 can have a slight curvature to them to aid in the pivoting movement of cutting edge 134. Slots 180, 194 are preferably sized to permit about +/−1.93 degrees of pivoting movement of cutting edge 134.

Figure 7B:
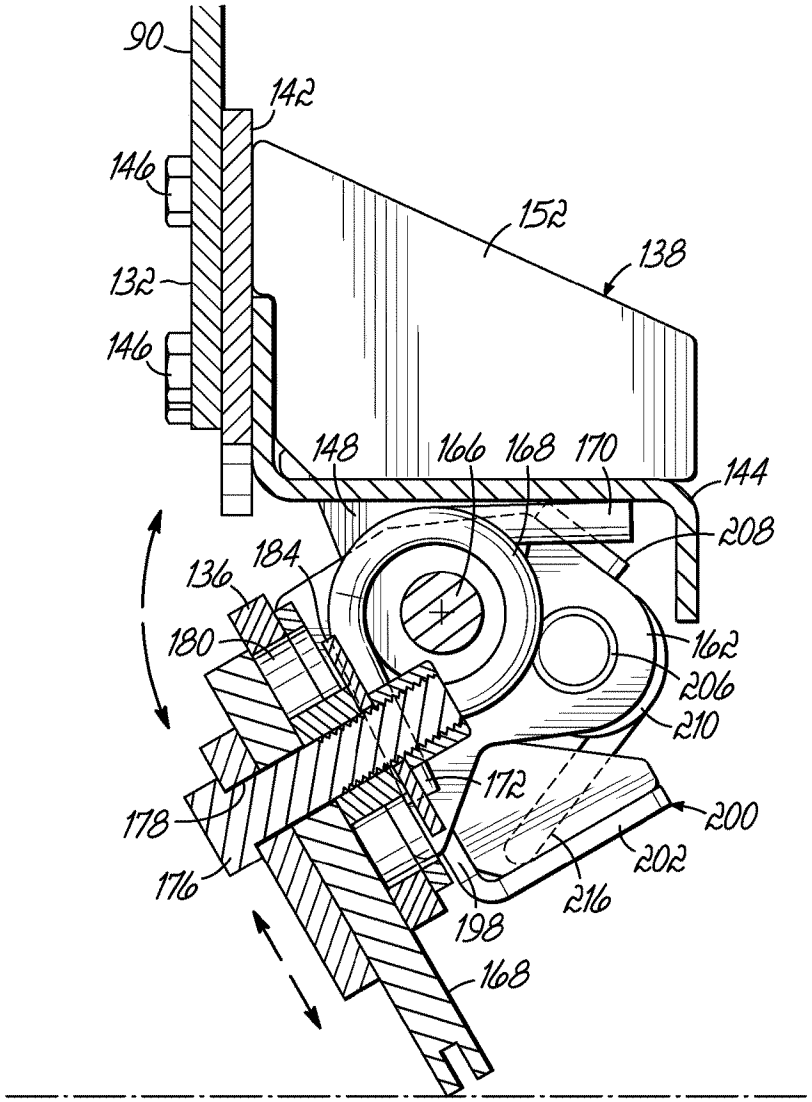
FIG. 7B is a view similar to FIG. 7A illustrating the wing cutting edge pivoted rearward.
Figure 7A:
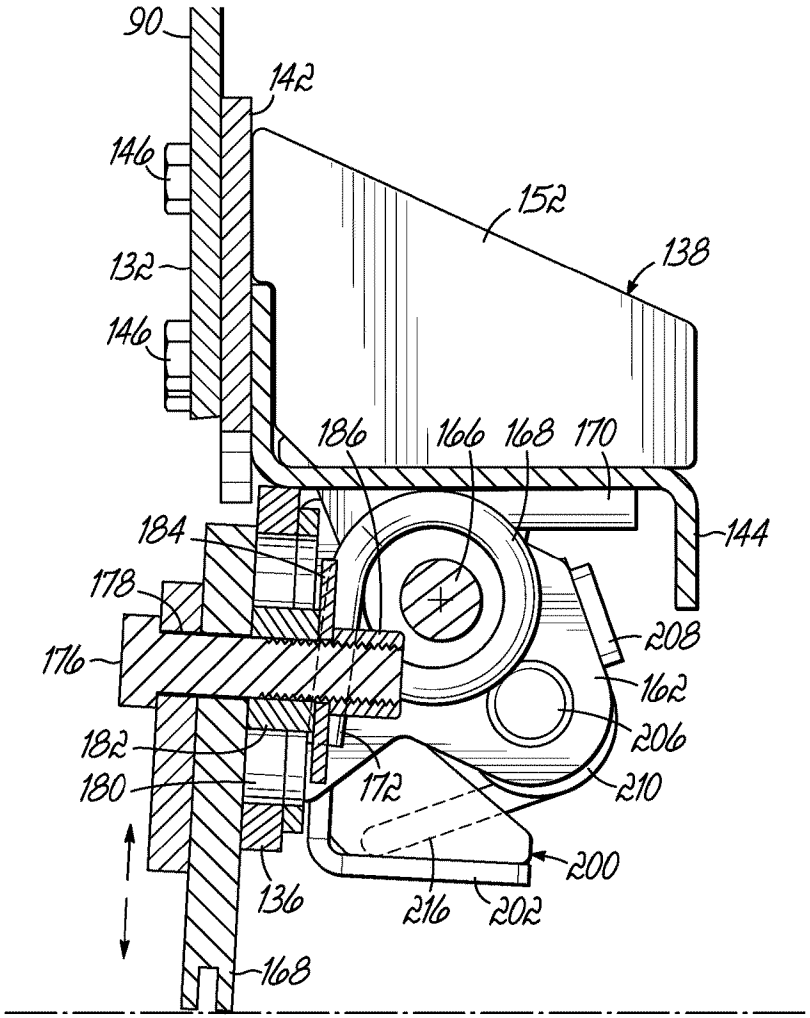
FIG. 7A is a cross-sectional view taken along line 7A-7A in FIG. 6 illustrating the wing cutting edge in a neutral position.

FIG. 7A illustrates the cutting edge 134 in the neutral position.

In FIG. 7B, the cutting edge 134 has been pivoted rearward against the bias of the torsion springs 168, as when encountering a surface obstruction.

Figure 8B:
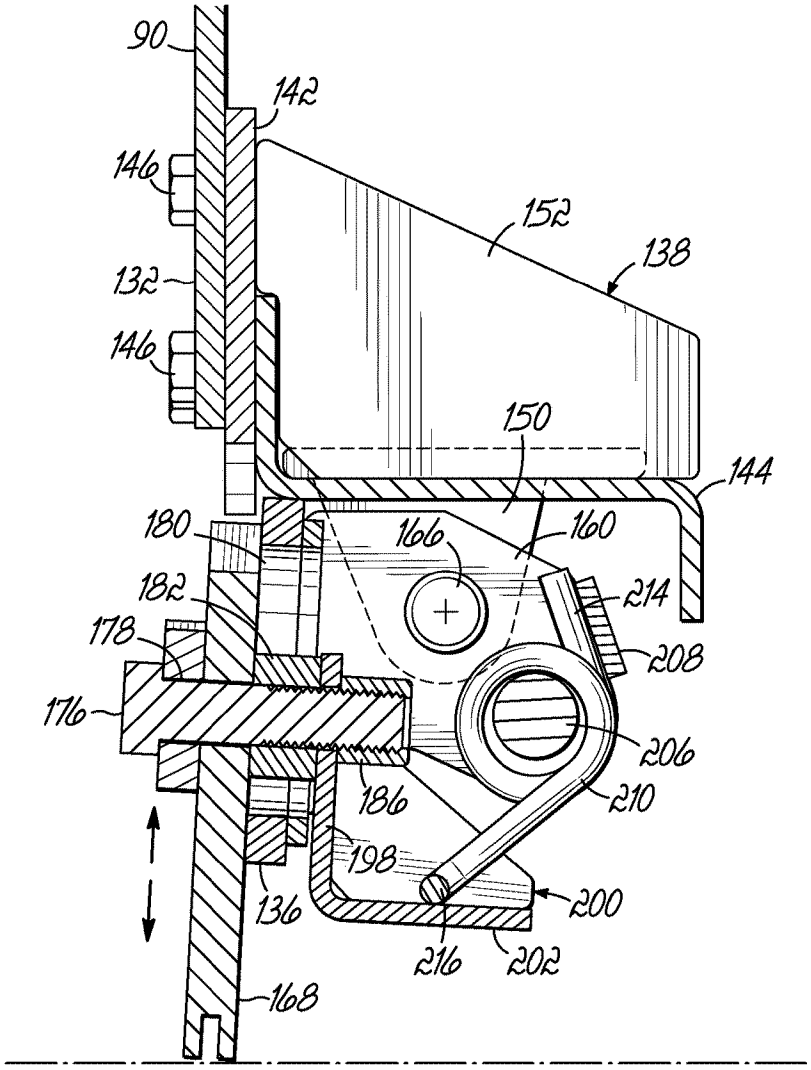
FIG. 8B is a view similar to FIG. 8A illustrating the wing cutting edge furthest from the pivot connection of the wing to the moldboard frame pivoted downward.
Figure 8A:
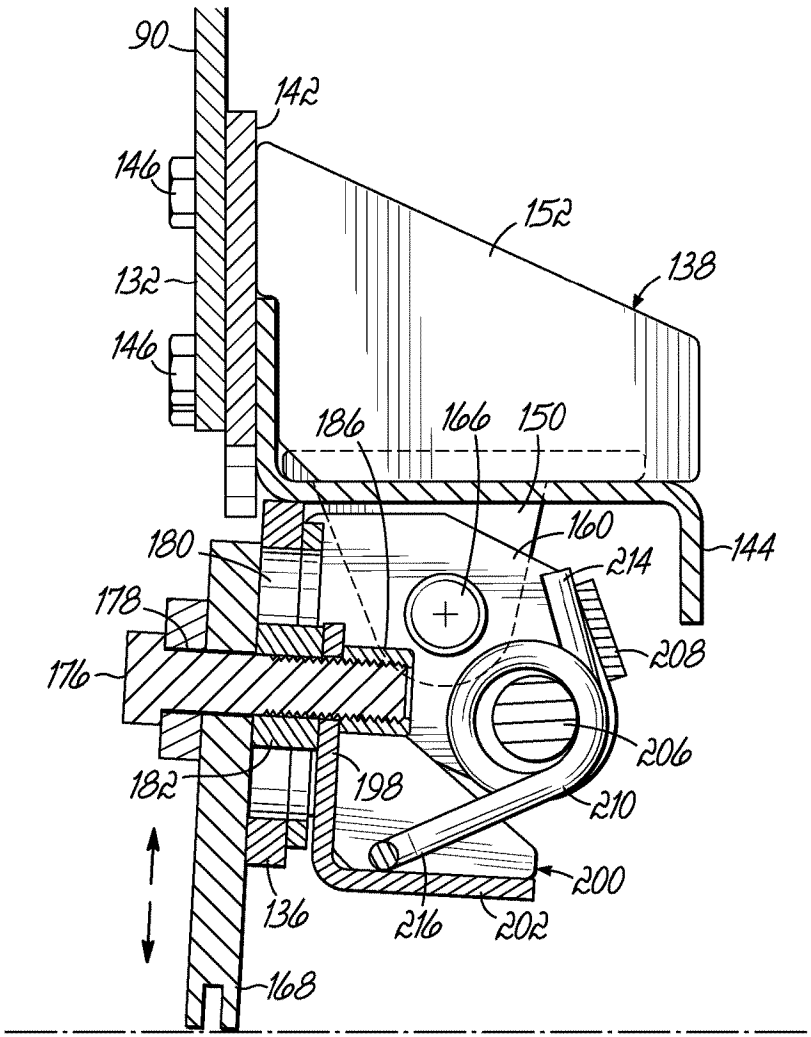
FIG. 8A is a cross-sectional view taken along line 8A-8A in FIG. 6 illustrating the wing cutting edge in a neutral position.

FIG. 8A also illustrates the cutting edge 134 in the neutral position.

In FIG. 8B, the bias of torsion spring 210 has caused pivoting of cutting edge 134 such that the outboard most end of the cutting edge 134 has moved downward, as when encountering a surface irregularity such as a depression.

Figure 9A:
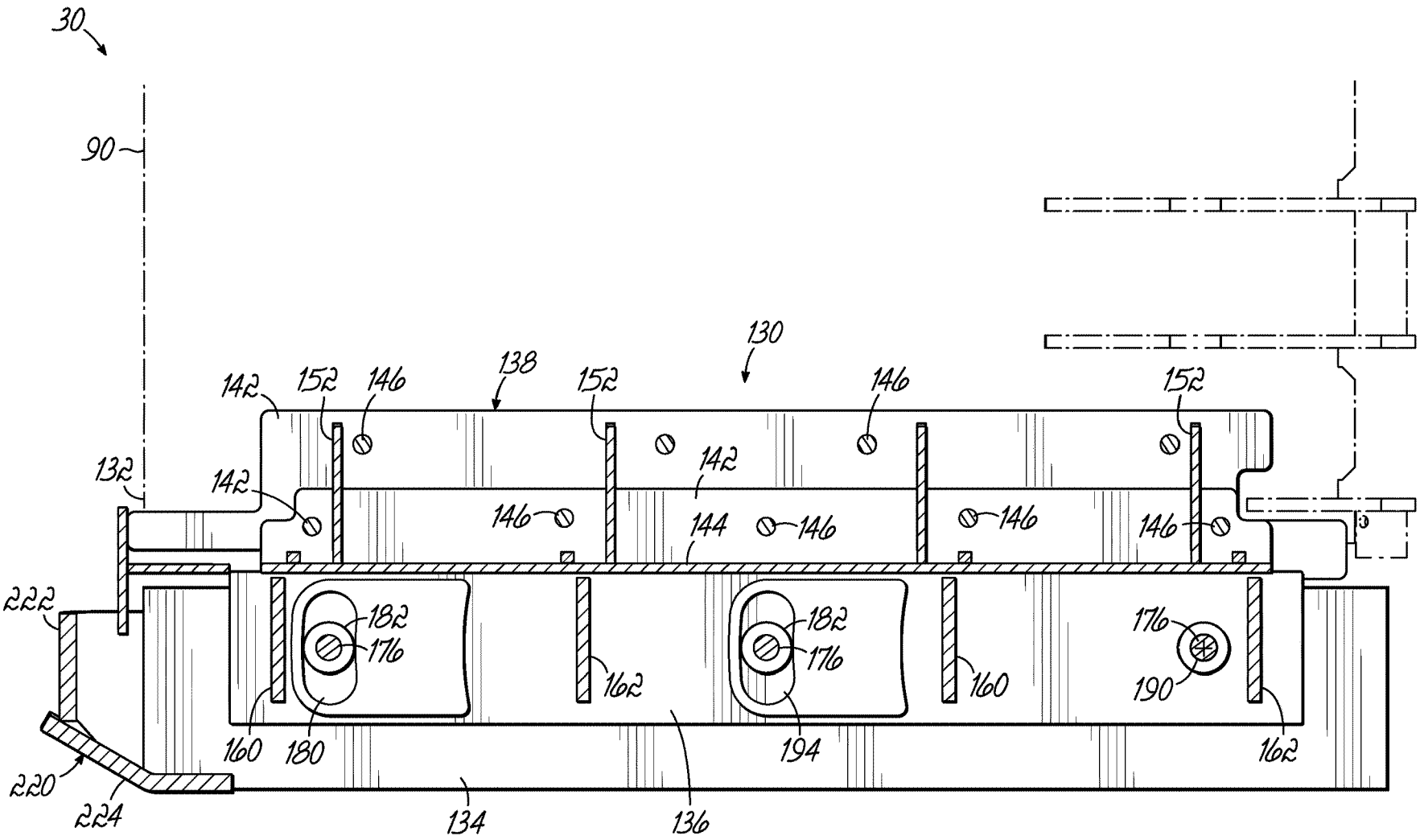
FIG. 9A is a rear view partially broken away of the left hand wing cutting edge in the neutral position.

FIG. 9A also illustrates the cutting edge 134 in the neutral position.

Figure 9B:
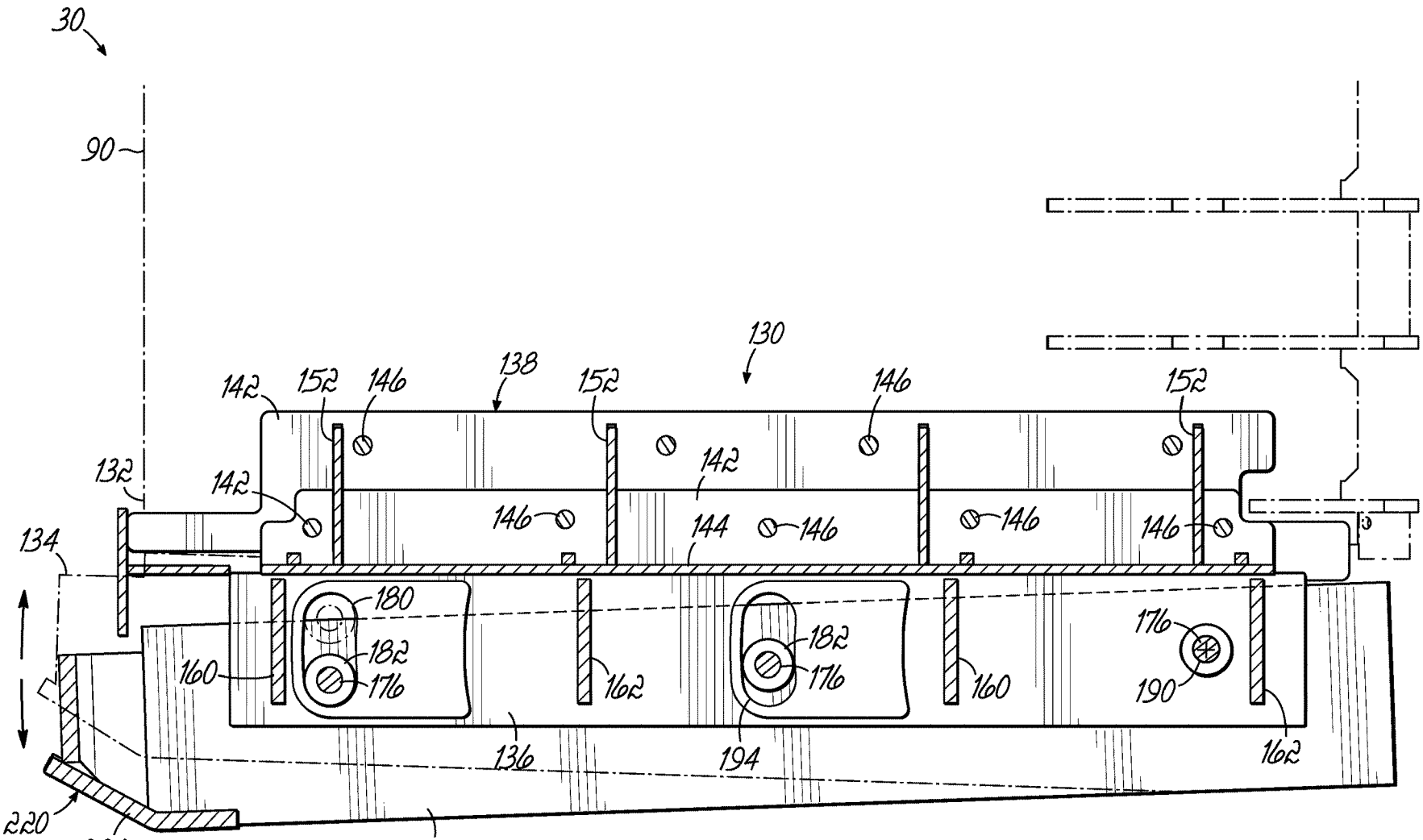
FIG. 9B is a view similar to FIG. 9A illustrating the wing cutting edge furthest from the pivot connection of the wing to the moldboard frame pivoted upward and downward.

In FIG. 9B, the bias of torsion spring 210 has caused pivoting of cutting edge 134 such that the outboard most end of the cutting edge 134 has moved downward, as when encountering a surface irregularity such as a depression.

In order to assist pivoting of the cutting edge 134 about the pivot axis provided by pin 166 and the pivot axis provided by inboard most bolt 176, a shoe 220 is secured to a forward surface of cutting edge 134 with the two outboard most bolts 176. Shoe 220 has a rearward turned portion 222 and an upturned portion 224. These portions 222, 224 assist in such pivoting when encountering surface obstructions and surface irregularities.

Figure 10:
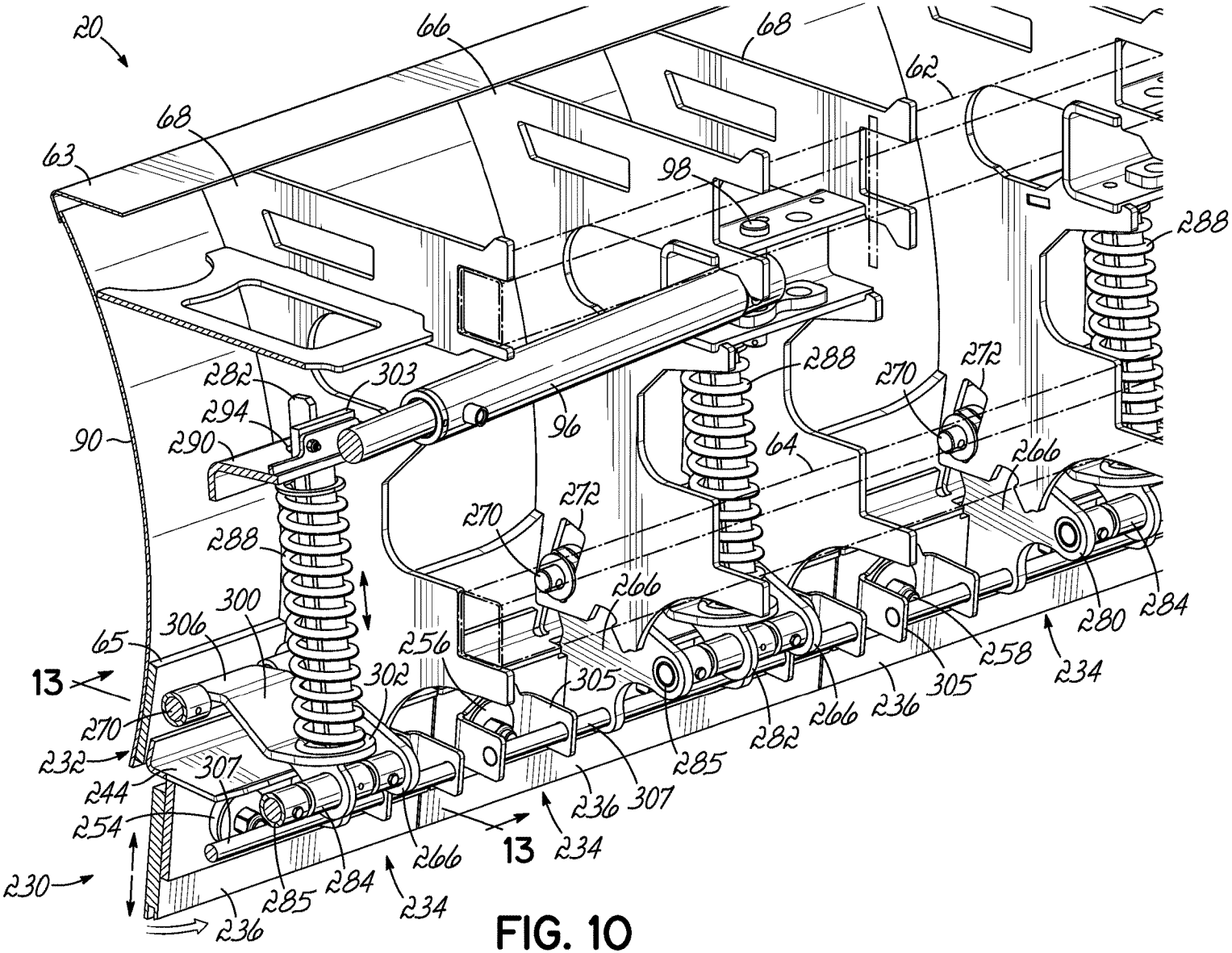
FIG. 10 is a rear, left, top perspective view in cross-section taken just inboard of the pivot connection of the left hand wing to the moldboard frame.
Figure 11:
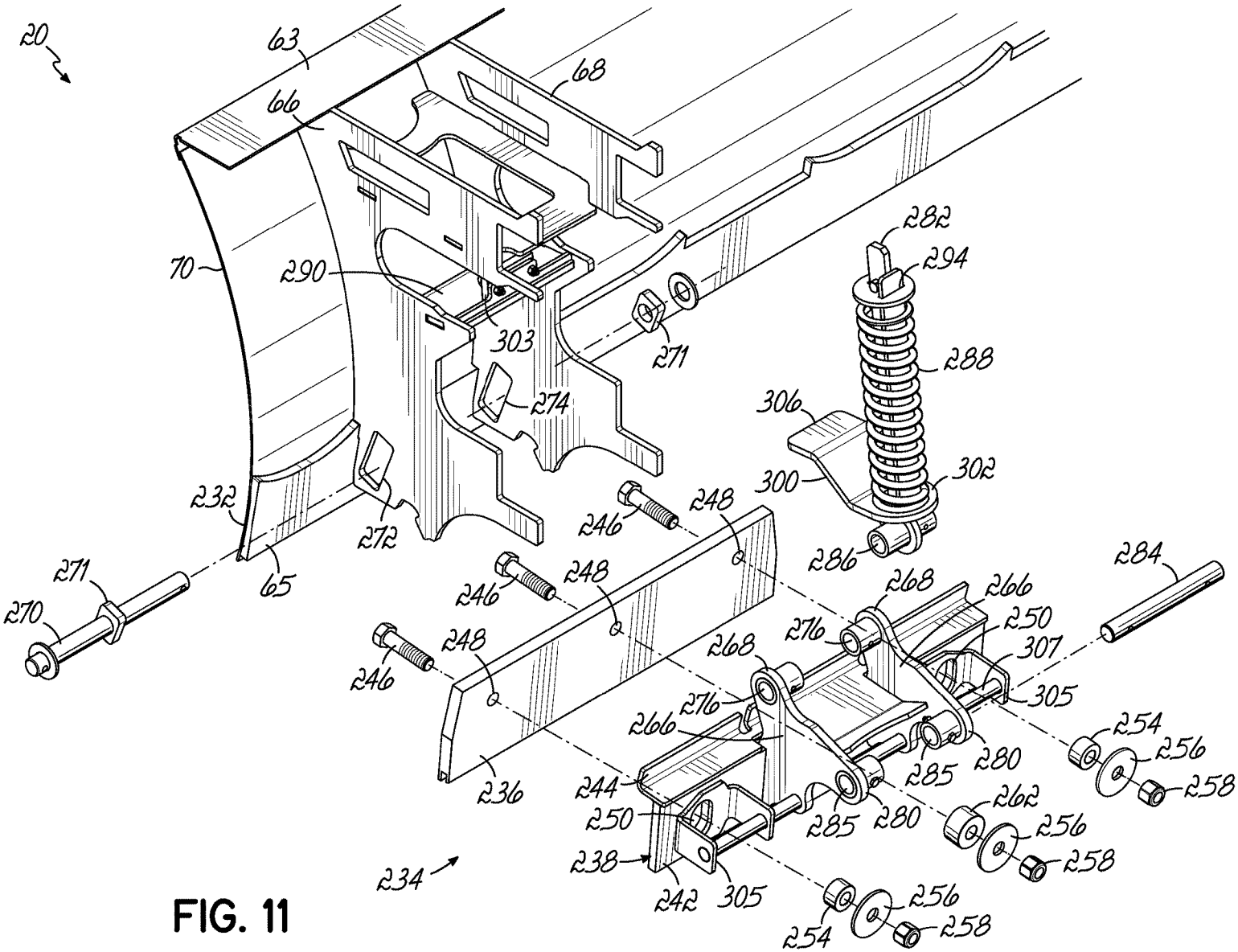
FIG. 11 is a rear, left, top, exploded perspective view of a moldboard cutting edge segment.
Figure 12:
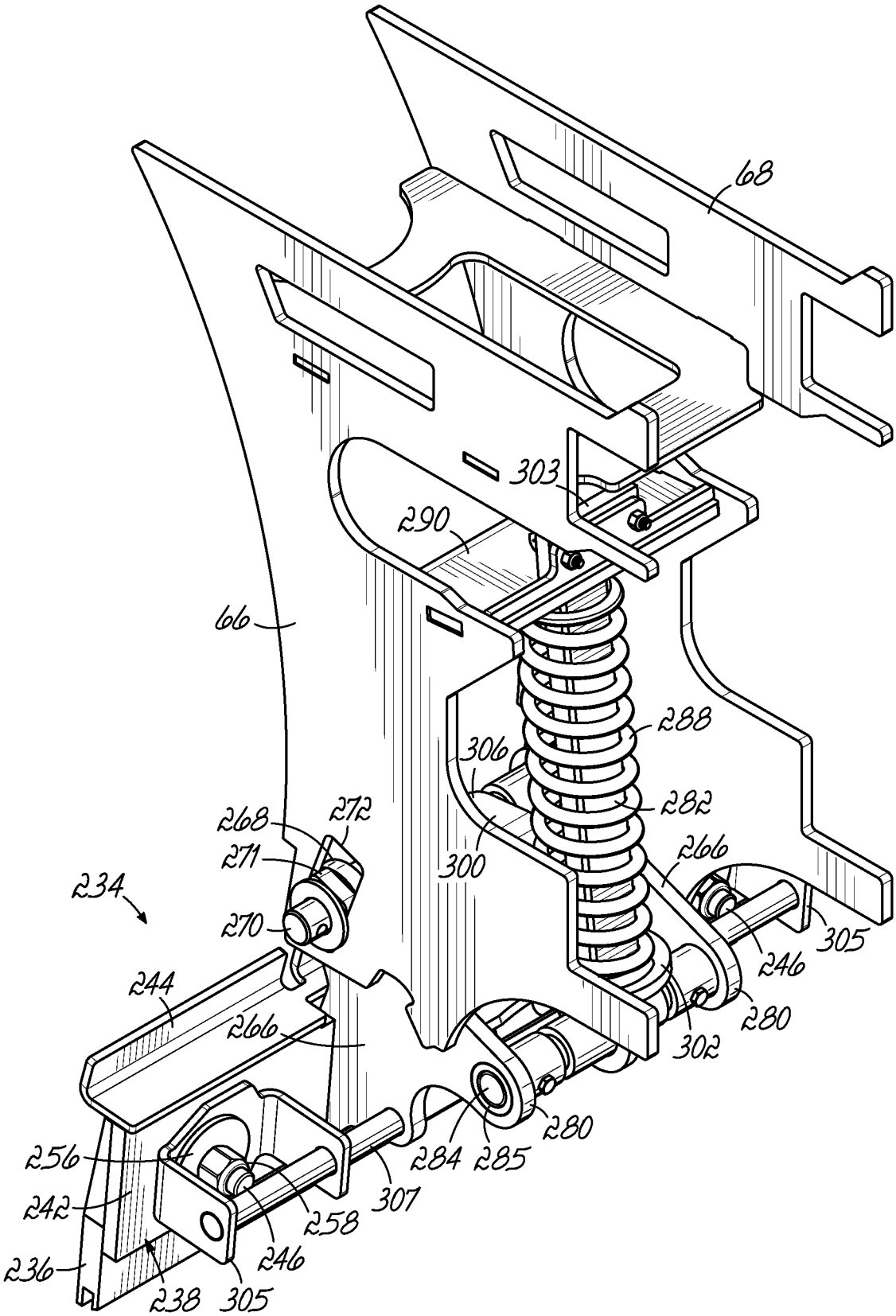
FIG. 12 is a view similar to FIG. 11 in assembled form.

Referring to FIGS. 10-12, moldboard 70 includes a moldboard cutting edge assembly 230 mounted to a lower edge or edge region 232 of moldboard 70. Assembly 230 is made up of a plurality of moldboard cutting edge segment subassemblies 234. Each subassembly 234 includes a cutting edge segment 236 and a cutting edge segment support plate 238, and is mounted to each rib pair 66, 68.

Support plate 238 is generally L-shaped in cross-section having a leg portion 242 and a foot portion 244. Cutting edge segment 236 is secured to leg portion 242 of support plate 238 with three fasteners 246, for example bolts. The bolts 246 adjacent the ends of the cutting edge segment 236 pass through holes 248 in the segment 236 and through generally vertical slots 250 in the leg portion 242 of the support plate 238, i.e. the longitudinal axes of slots 250 are generally perpendicular the longitudinal axis of support plate 238. These bolts 246 pass through bushings 254 positioned in slots 250 and through washers 256 positioned against a rearward surface of the leg portion 242 of support plate 238. Nuts 258 on these bolts 246 secured the cutting edge segment 236, support plate 238, bushings 254, and washers 256 together.

The third bolt 246 passes through a hole 248 located medially of the length of the cutting edge segment 236, through a hole 260 in the leg portion 242 of the support plate 238, through a bushing 262 positioned in hole 260, and through washer 256. A nut 258 on this bolt 246 secures the cutting edge segment 236, support plate 238, bushing 262, and washer 256 together. Cutting edge segment 236 is thus freely pivotally connected to support plate 238 and hence moldboard 70 for pivoting movement about an axis generally perpendicular to the lower edge or edge region 232 of moldboard 70 (i.e., a generally horizontal, generally longitudinal axis (parallel to longitudinal axis of vehicle) when moldboard 70 is positioned facing forward as shown in FIG. 15A). Slots 250 can have a slight curvature to them to aid in the pivoting movement of cutting edge segment 236. Each cutting edge segment 236 is preferably about two feet long, and slots 250 are preferably sized to permit about +/−5 degrees of pivoting movement of cutting edge segment 236.

Support plate 238 includes a pair of plates 266 secured to leg portion 242 and foot portion 244 forming a pivot link. Upper forward ends 268 of plates 266 are pivotally connected to rib pair 66, 68 of moldboard frame 60 by a pivot pin 270 passing through slots 272, 274 in ribs 66, 68, respectively, and through holes 276 in upper forward ends 268. Pin 270 carries a guide element 271 on each end. Guide elements 271 ride in slots 272, 274. Slots 272, 274 are oriented such that their longitudinal axes are generally, or roughly, parallel to the lower edge or edge region 232 of moldboard 70. With main or central plow assembly 20 lowered to a resting position on pavement, lower edge or edge region 232 of moldboard 70 is preferably about 6 degrees from vertical, and the longitudinal axes of slots 272, 274 are preferably about 14 degrees from lower edge or edge region 232. Accordingly, as used herein, "generally, or roughly, parallel to the lower edge or edge region 232 of moldboard 70" is deemed to embrace angular values of between about 0 degrees (parallel) and about 14 degrees (deviation from parallel) of the longitudinal axes of slots 272, 274 relative to the lower edge or edge region 232 of moldboard 70. Support plate 238 and hence cutting edge segment 236 are thus pivotally connected to moldboard frame 60 for pivoting movement about an axis generally parallel to the lower edge or edge region 232 of moldboard 70 (i.e., a generally horizontal, generally transverse axis (transverse to longitudinal axis of vehicle) when moldboard 70 is positioned facing forward as shown in FIG. 15A), as well as mounted for upward/downward translational movement, which movement is generally, or roughly, parallel to the lower edge or edge region 232 of moldboard 70. Slots 272, 274 are preferably sized to permit about +/−1.5 inches of vertical travel of cutting edge segment 236. Moldboard cutting edge segment subassembly 234 is preferably configured to permit about 40 degrees of rearward pivoting movement of cutting edge segment 236.

Lower rearward ends 280 of plates 266 are pivotally connected to a link 282 by a pivot pin 284 passing through holes 285 in ends 280 and hole 286 in lower end of link 282. A compression spring 288 encircles link 282. A plate 290 interconnects ribs 66, 68 and has an opening 294 therein. An upper end of spring 288 is captured against an underneath surface of plate 290 whilst an upper end of link 282 is free to slide upwardly and downwardly in opening 294 in plate 290. The lower end of spring 288 rests upon a plate 300 having a lower rearward end 302 with an opening 304 therein through which link 282 passes and an upper forward end 306 which rests upon pivot pin 270 when the moldboard cutting edge segment subassembly 234 is in the neutral position. Plate 300 overlies and is secured to a forward projecting leg 301 of link 282. To reduce friction during travel of link 282 upwardly and downwardly, a block 303 of UHMW is secured just forward of a rear edge of opening 294 for link 282 to ride against. Compression spring 288 serves to both bias the cutting edge segment 236 forward relative to the lower edge or edge region 232 of moldboard 70 about the pivot axis generally parallel to the lower edge or edge region 232 of moldboard 70 as well as bias the cutting edge segment 236 downward relative to the lower edge or edge region 232 of moldboard 70.

A U-shaped bracket 305 is secured to a rear surface of each end of support plate 238. Brackets 305 act as a wear pad for bushings 254. A rod 307 passes through holes in the legs of U-shaped brackets 305 and through holes in link plates 266 and provides rigidity to the support plate 238.

Figure 13A:
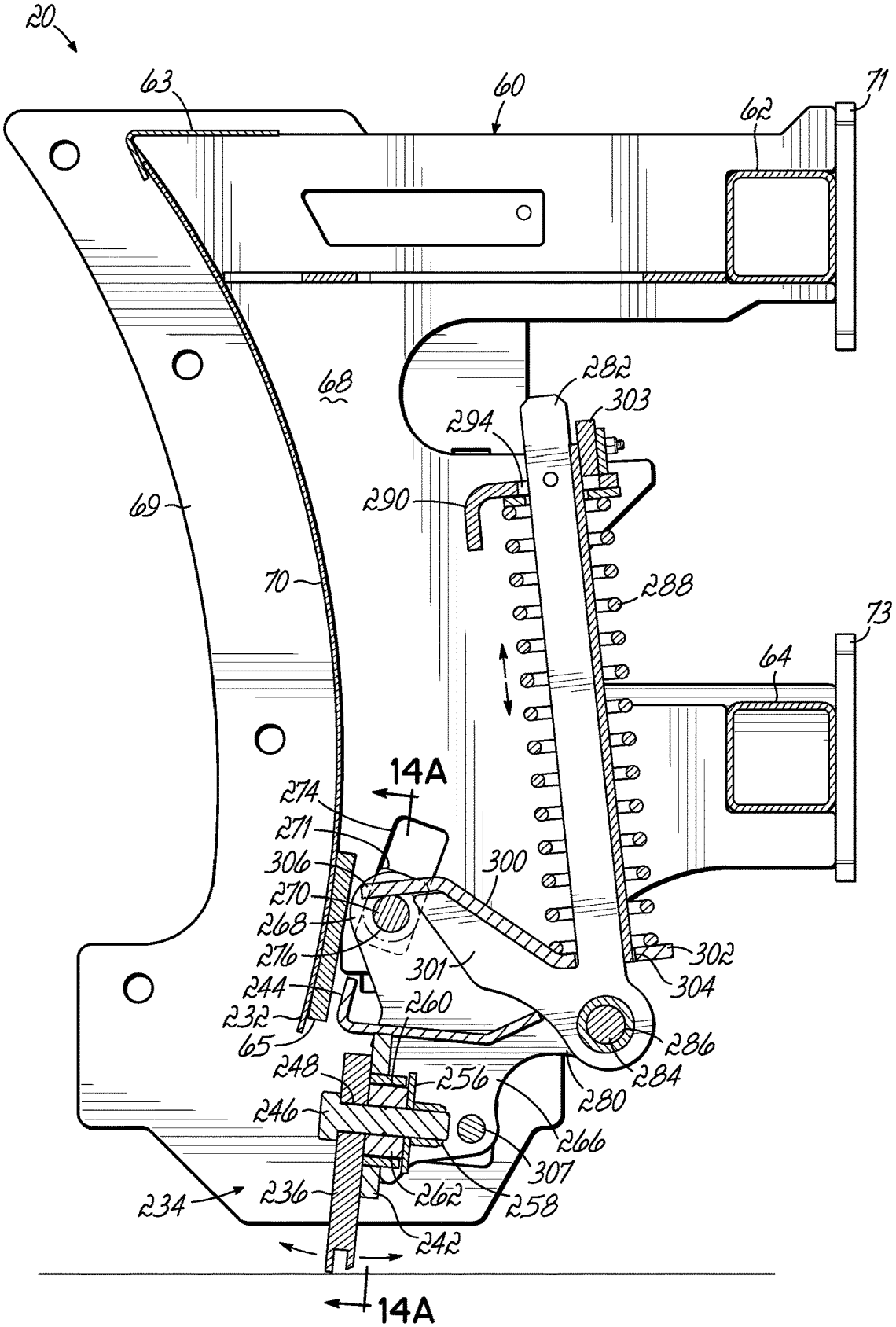
FIG. 13A is a cross-sectional view taken along line 13A-13A in FIG. 10 illustrating the moldboard cutting edge segment in neutral position.

FIG. 13A illustrates the cutting edge segment 236 in the neutral position.

Figure 13B:
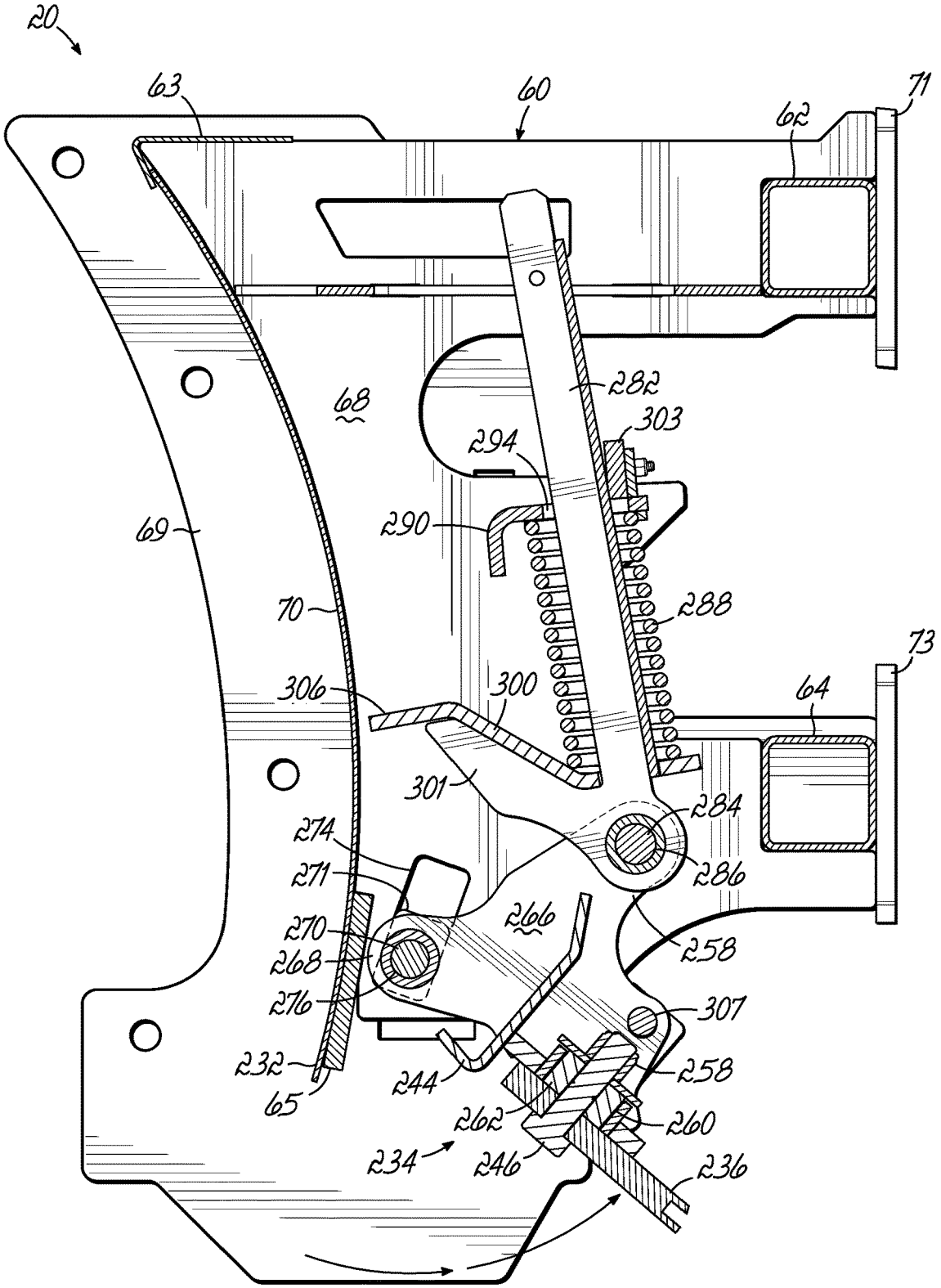
FIG. 13B is a view similar to FIG. 13A illustrating the moldboard cutting edge segment pivoted rearward.

In FIG. 13B, the cutting edge segment 236 has been pivoted rearward against the bias of the compression spring 288, as when encountering a surface obstruction.

Figure 13C:
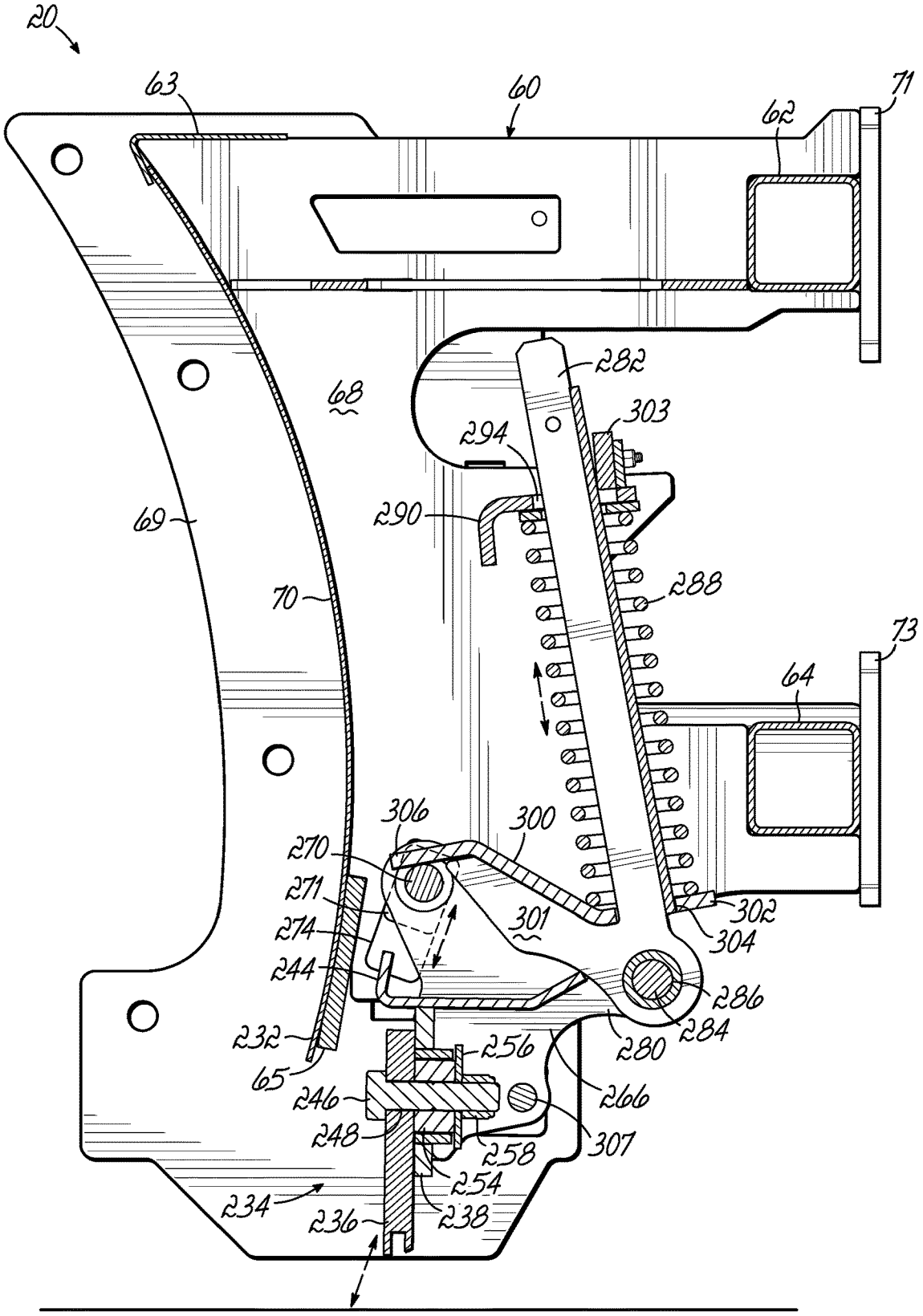
FIG. 13C is a view similar to FIG. 13B but illustrating the moldboard cutting edge segment translated upward.

In FIG. 13C, cutting edge segment 236 has been translated upwardly against the bias of compression spring 288, as when encountering a surface irregularity such as a rise.

Figure 14A:
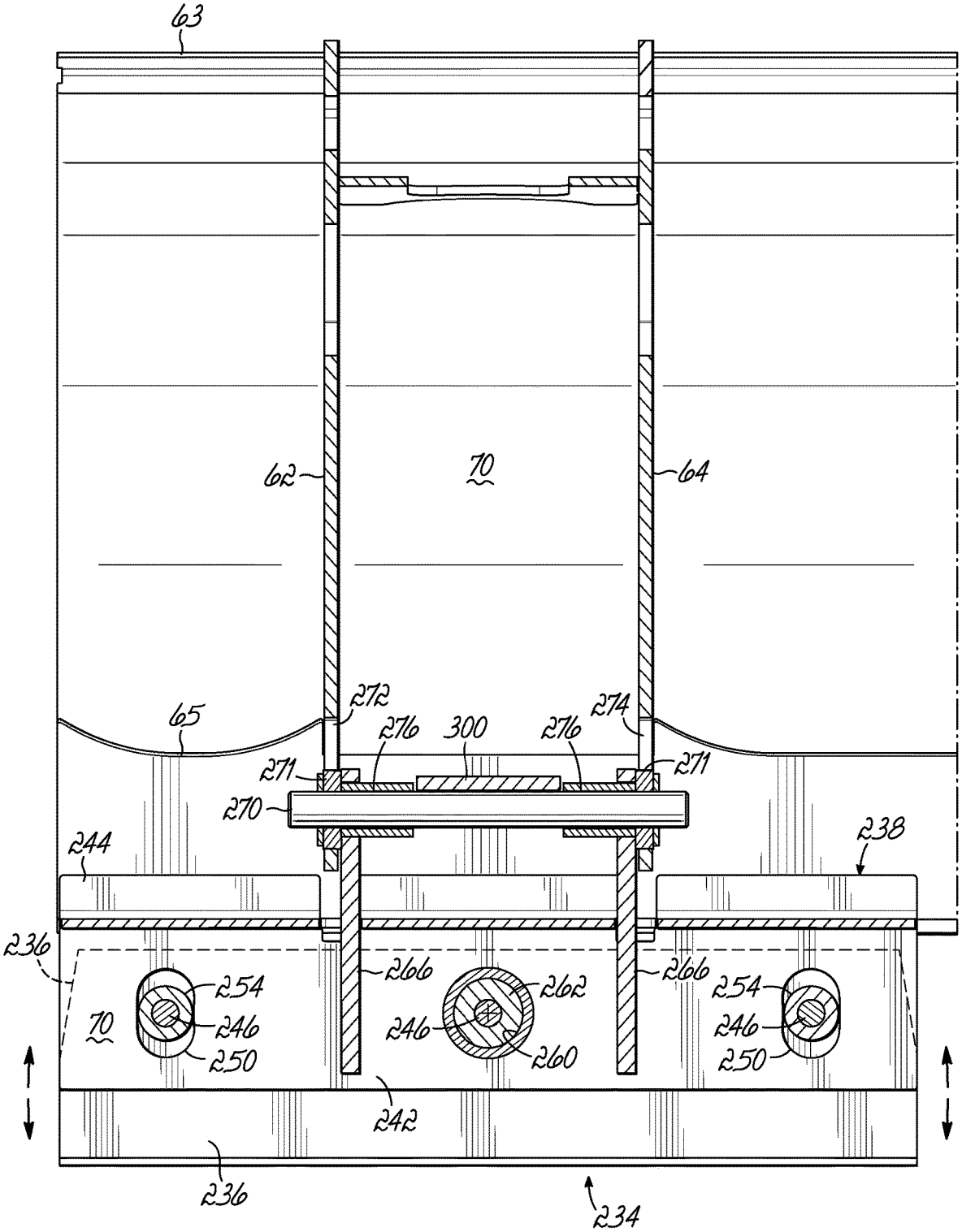
FIG. 14A is a cross-sectional view taken along line 14A-14A in FIG. 13A illustrating the moldboard cutting edge segment in the neutral position.

FIG. 14A also illustrates the cutting edge segment 236 in the neutral position.

Figure 14B:
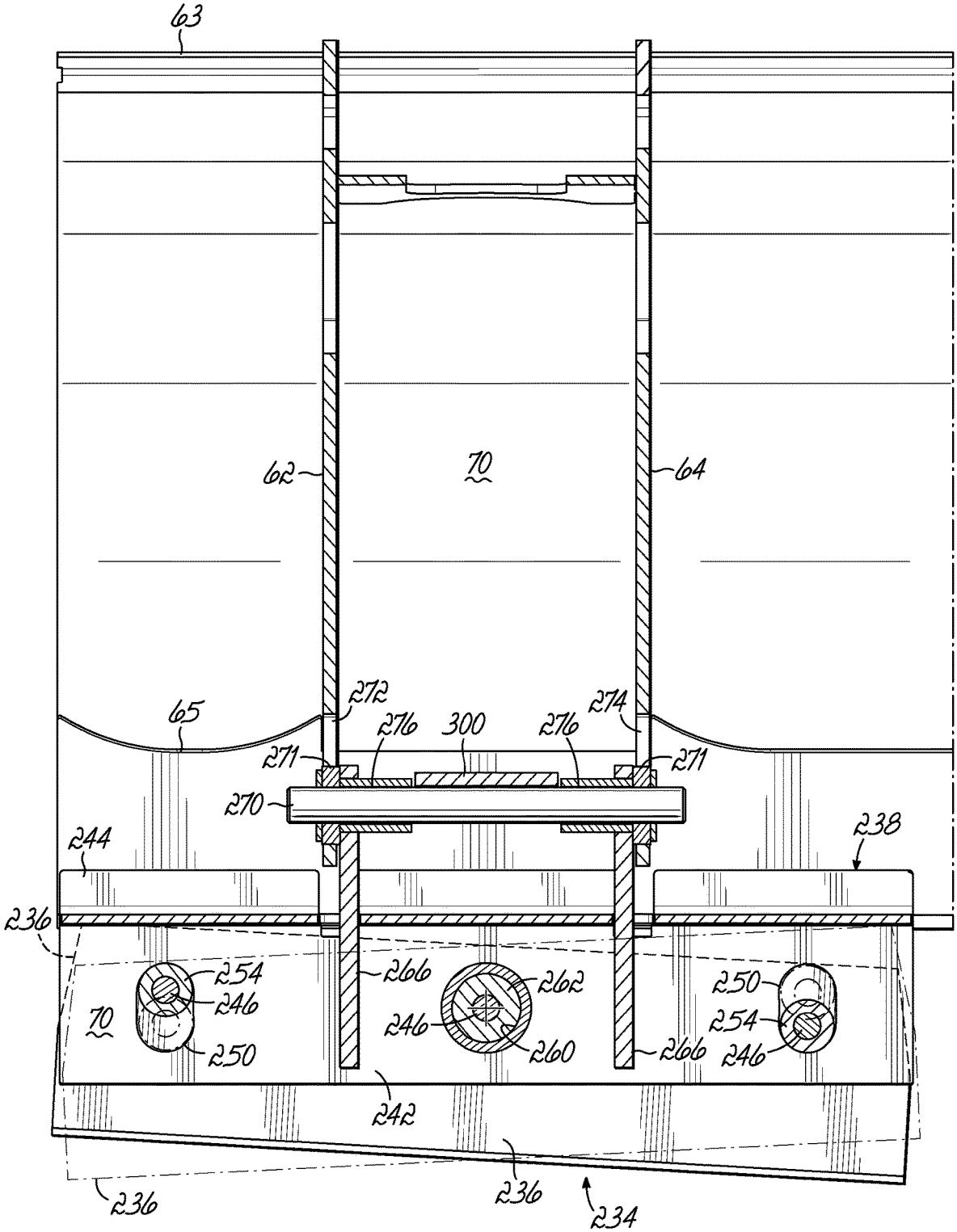
FIG. 14B is a view similar to FIG. 14A illustrating pivoting of the moldboard cutting edge segment about a point medially of its length.

In FIG. 14B, the cutting edge segment 236 is shown pivoting about the pivot axis generally perpendicular to the lower edge or edge region 232 of moldboard 70 as when encountering surface irregularities such as rises or depressions.

Referring now to FIGS. 16-19B, and with like numbers representing like elements, an alternative embodiment of wing cutting edge assembly 130 is illustrated. In this embodiment, the pivot point providing pivoting movement of the cutting edge 134 to the support plate 136 and hence wing 90 about the axis generally perpendicular to the lower edge or edge region 132 of wing 90 has been moved from an inboard end of the cutting edge 134 to between the inboard end and outboard end of the cutting edge 134. For example, the pivot point can be located midway between the inboard and outboard ends of the cutting edge 134. This is accomplished by replacing the medial generally vertical slot 194 in the support plate 136 with a hole 190*a*, and by replacing hole 190 in the support plate 136 with a generally vertical slot 194*a*. In addition, the torsion spring 210 and associated structure has been eliminated, thus permitting the cutting edge 134 to freely pivot about center bolt 176. This arrangement provides free pivoting or "floating" of the cutting edge 134 about a central pivot axis not unlike the above-described cutting edge segment 236 being freely pivotally connected to support plate 238 and hence moldboard 70 for pivoting movement about an axis generally perpendicular to the lower edge or edge region 232 of moldboard 70, and provides similar advantages when it comes to better accommodating obstructions and surface irregularities. In addition, eliminating the torsion spring 210 and associated structure provides a cost reduction.

Figure 18B:
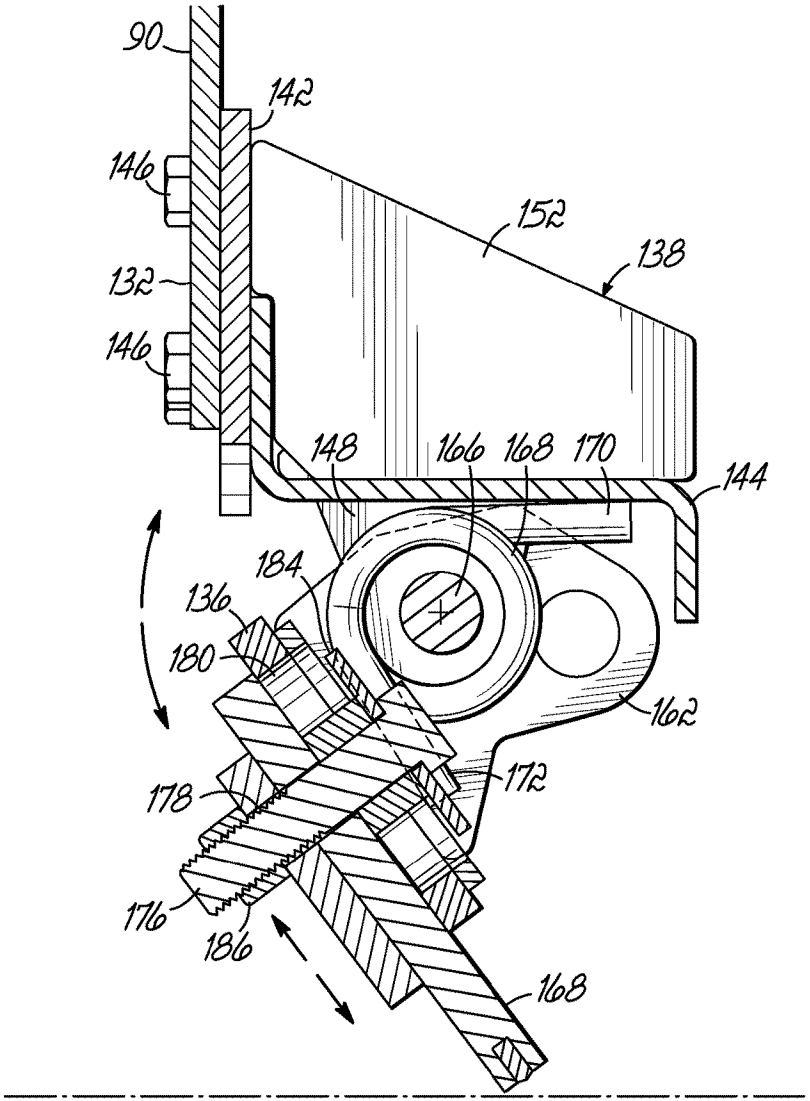
FIG. 18B is a view similar to FIG. 18A illustrating the wing cutting edge pivoted rearward.
Figure 18A:
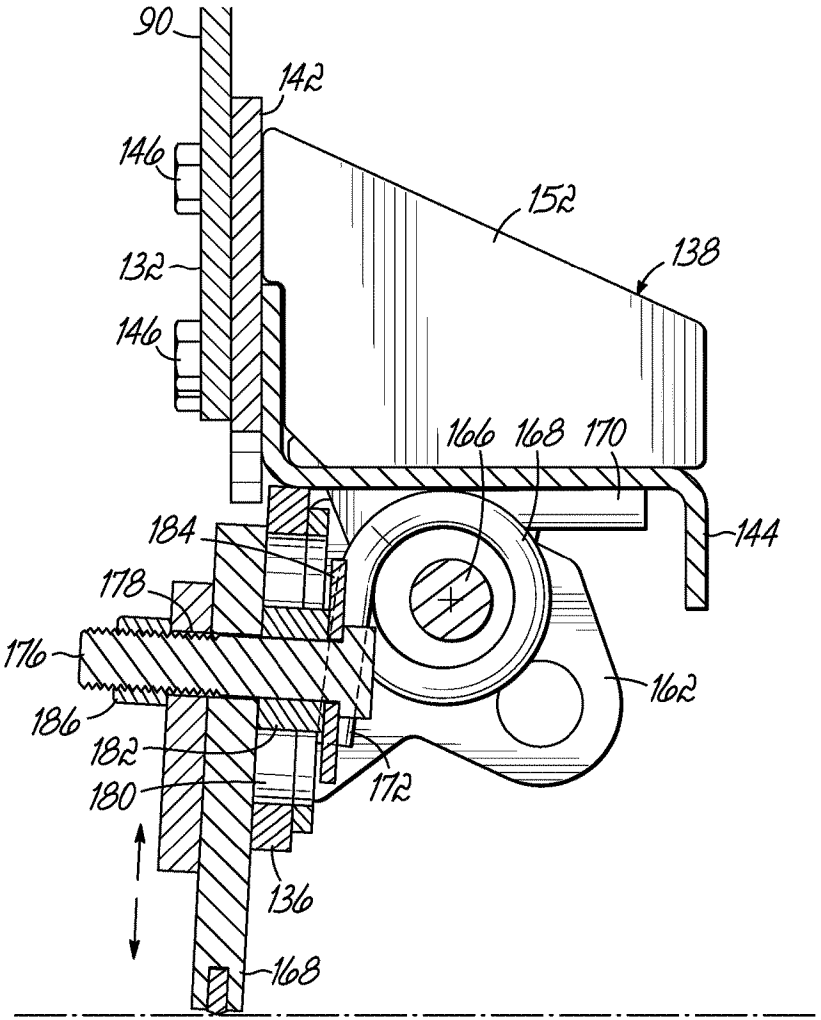
FIG. 18A is a cross-sectional view taken along line 18A-18A in FIG. 17 illustrating the wing cutting edge in a neutral position.

FIG. 18A illustrates the cutting edge 134 in the neutral position.

In FIG. 18B, the cutting edge 134 has been pivoted rearward against the bias of the torsion springs 168, as when encountering a surface obstruction.

Figure 19A:
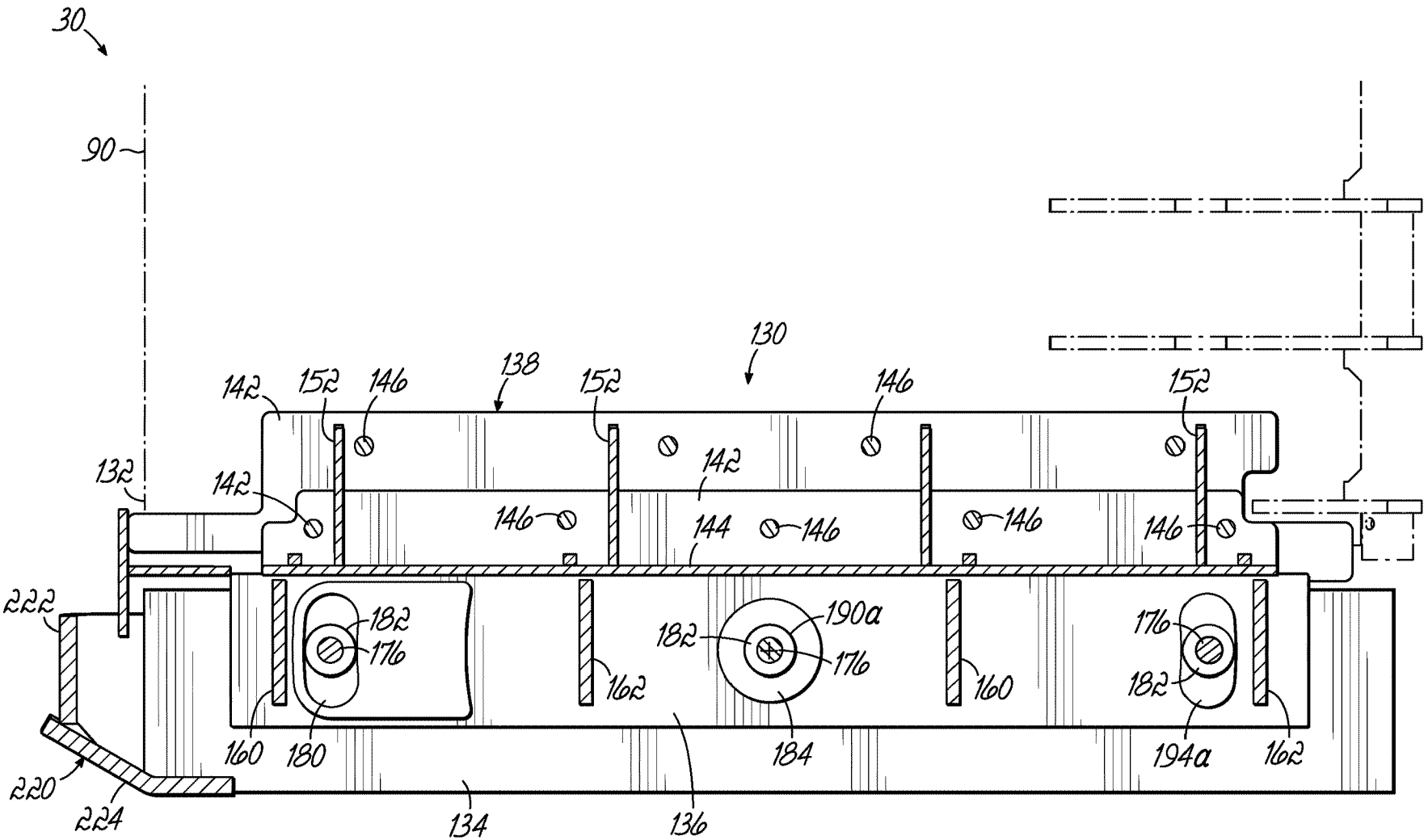
FIG. 19A is a rear view partially broken away of the left hand wing cutting edge in the neutral position.

FIG. 19A also illustrates the cutting edge 134 in the neutral position.

Figure 19B:
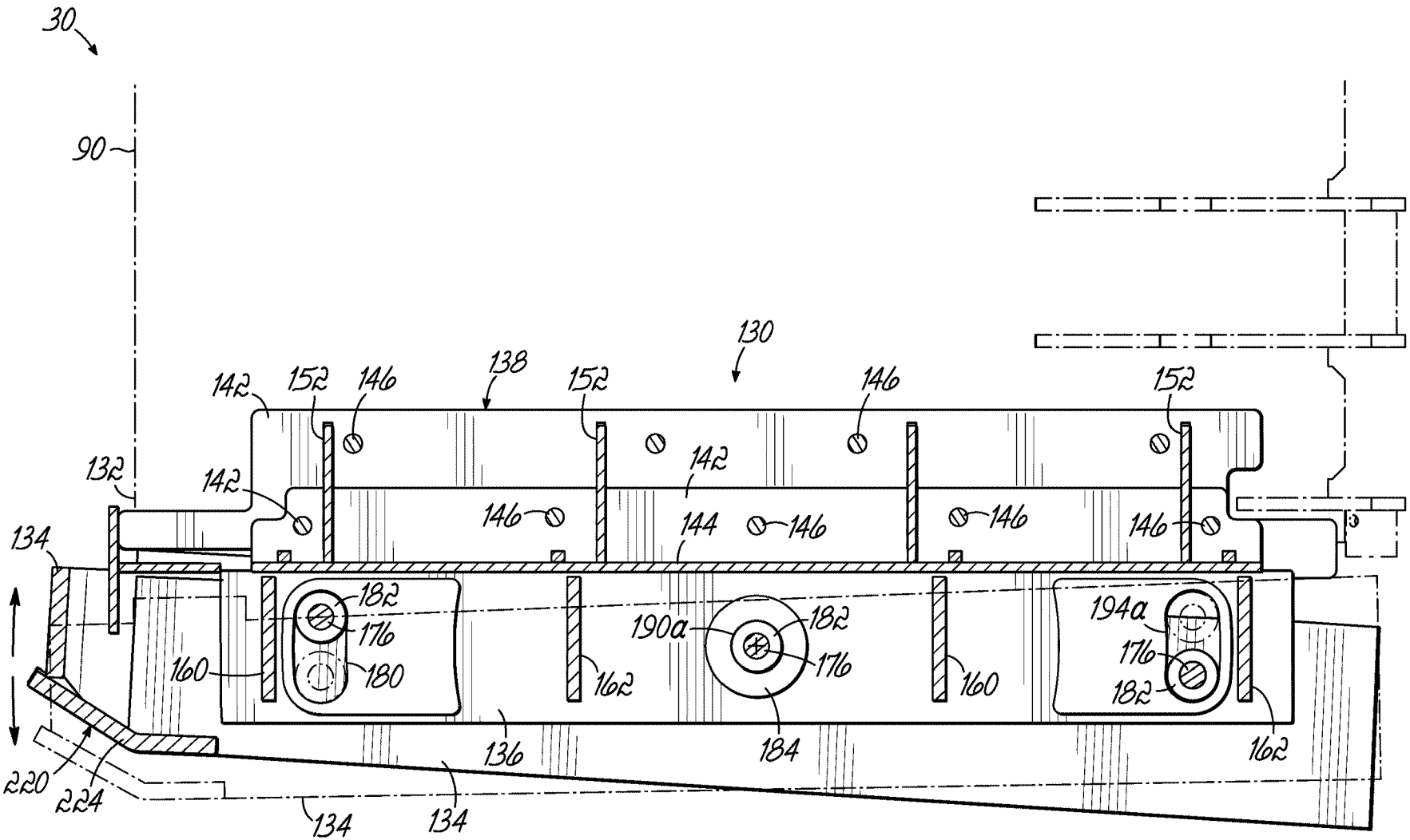
FIG. 19B is a view similar to FIG. 19A illustrating the wing cutting edge furthest from the pivot connection of the wing to the moldboard frame pivoted upward and downward.
Figure 20:
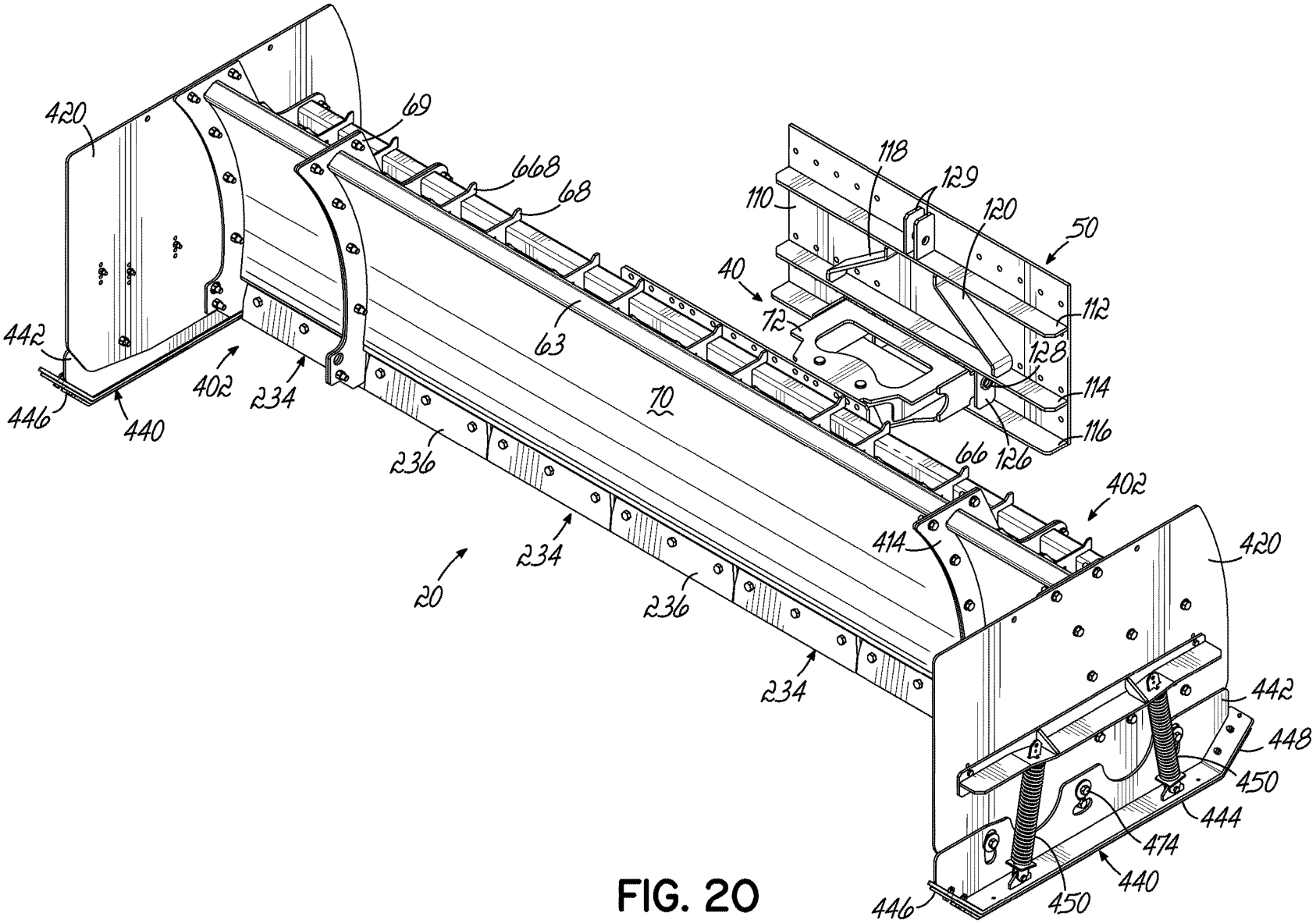
FIG. 20 is a front, left, top perspective view of another alternative embodiment of the plow with a fixed wing extension assembly.
Figure 21:
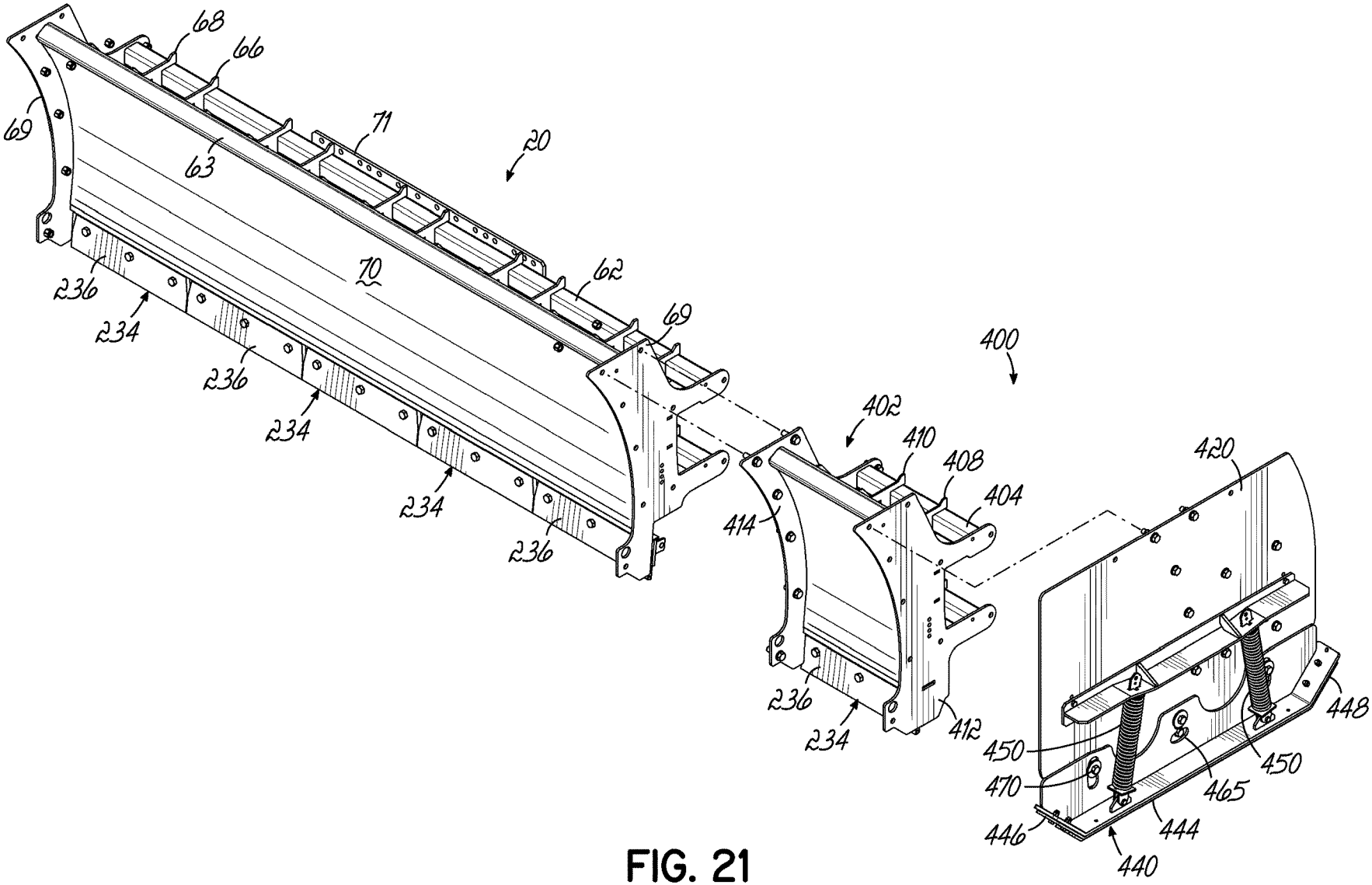
FIG. 21 is an exploded view similar to FIG. 20.
Figure 22:
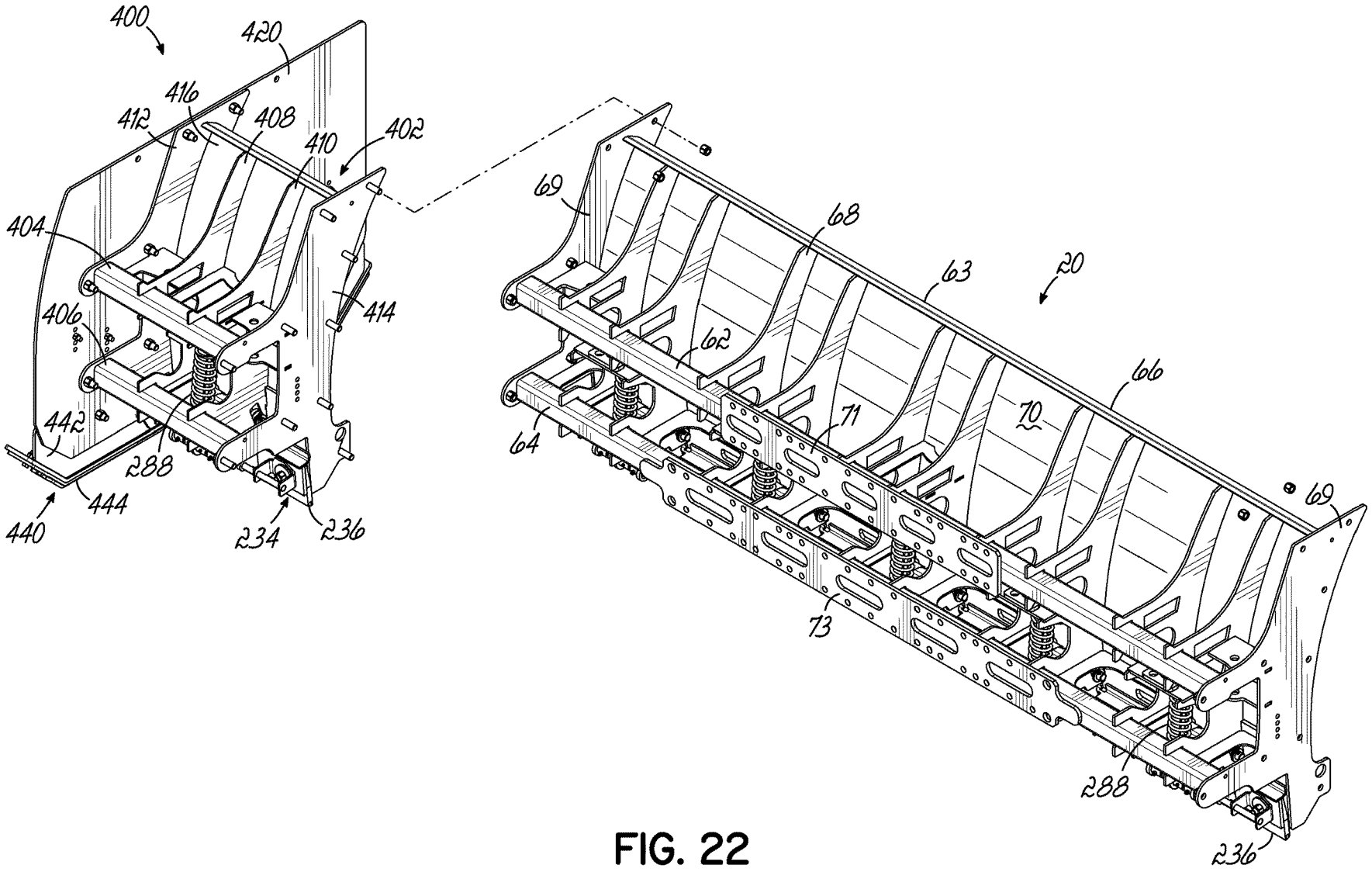
FIG. 22 is a rear, right, top exploded view of the plow of FIG. 20.
Figure 23:
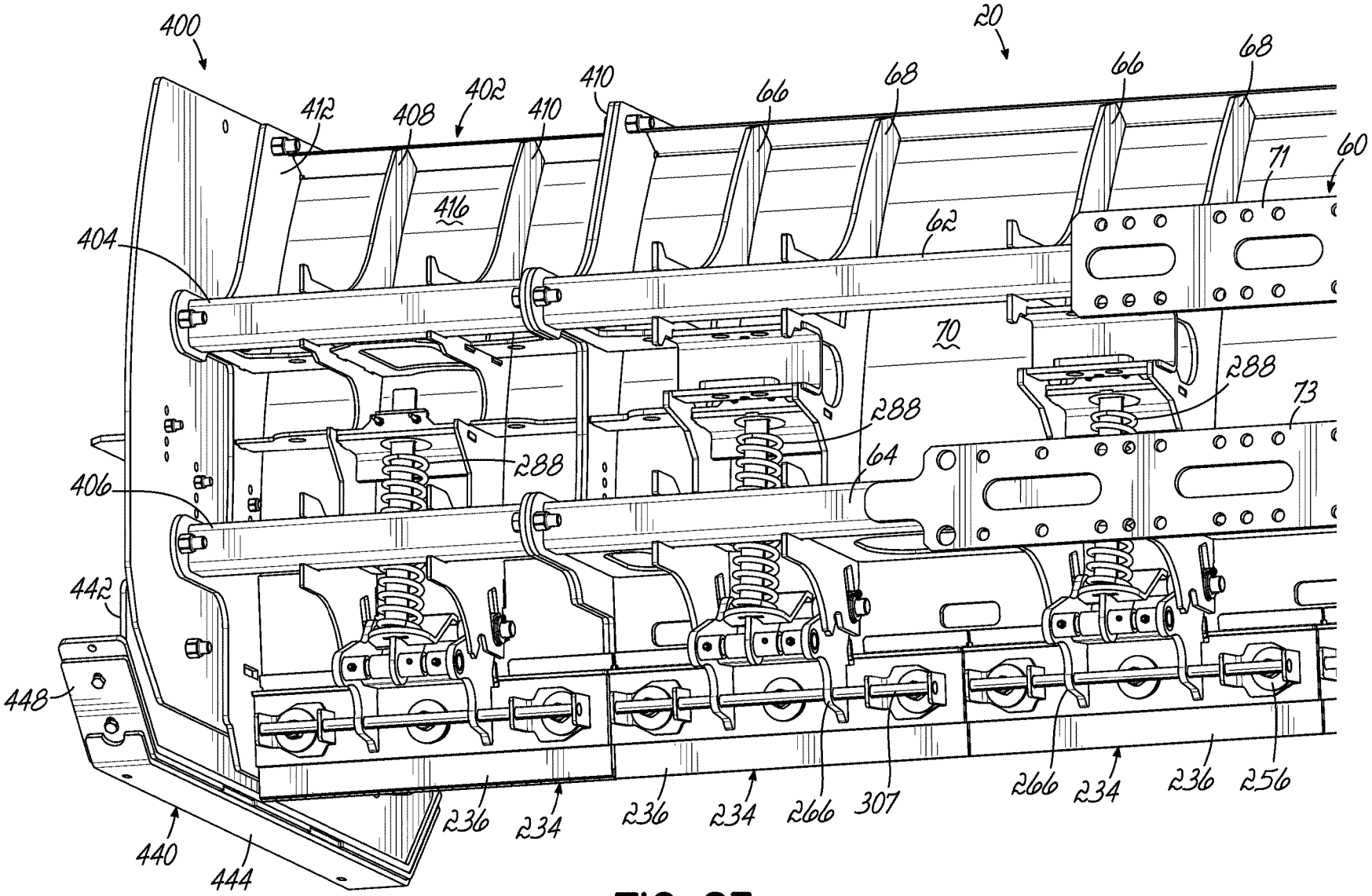
FIG. 23 is an enlarged rear, right, bottom view of the plow of FIG. 20.
Figure 24:
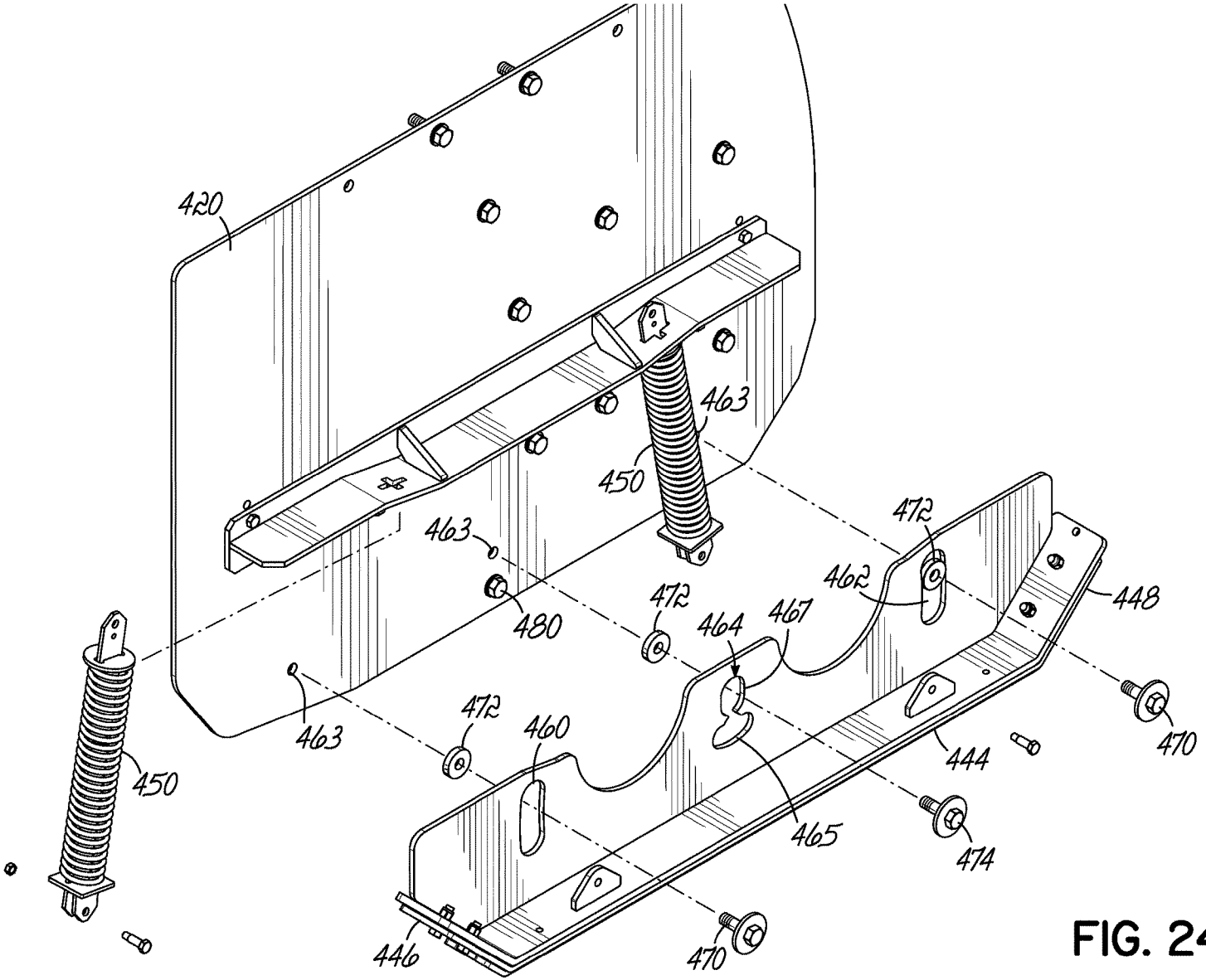
FIG. 24 is a rear, right, top exploded view of the wing of FIG. 20.
Figure 25:
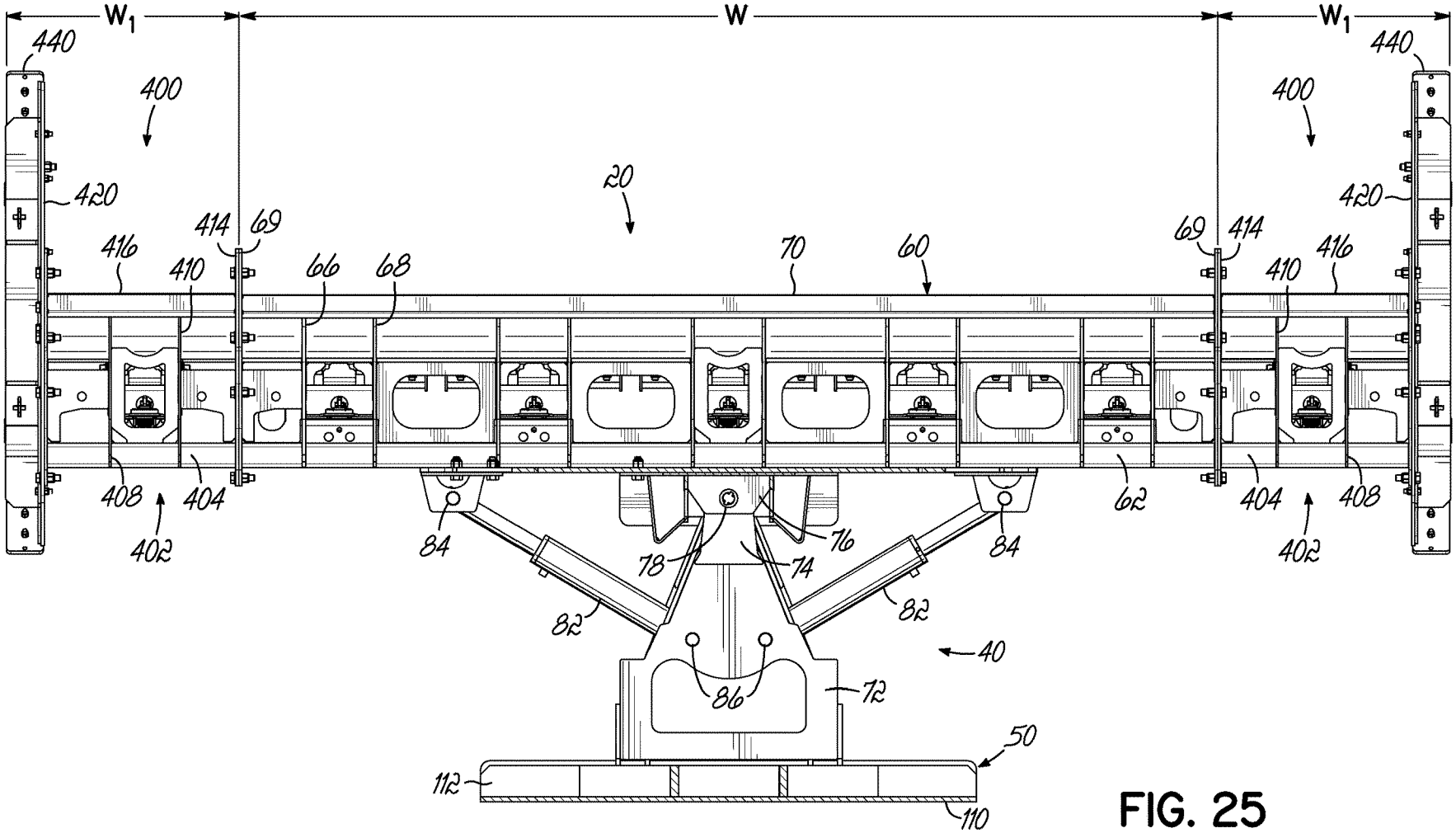
FIG. 25 is a top view thereof.
Figure 26A:
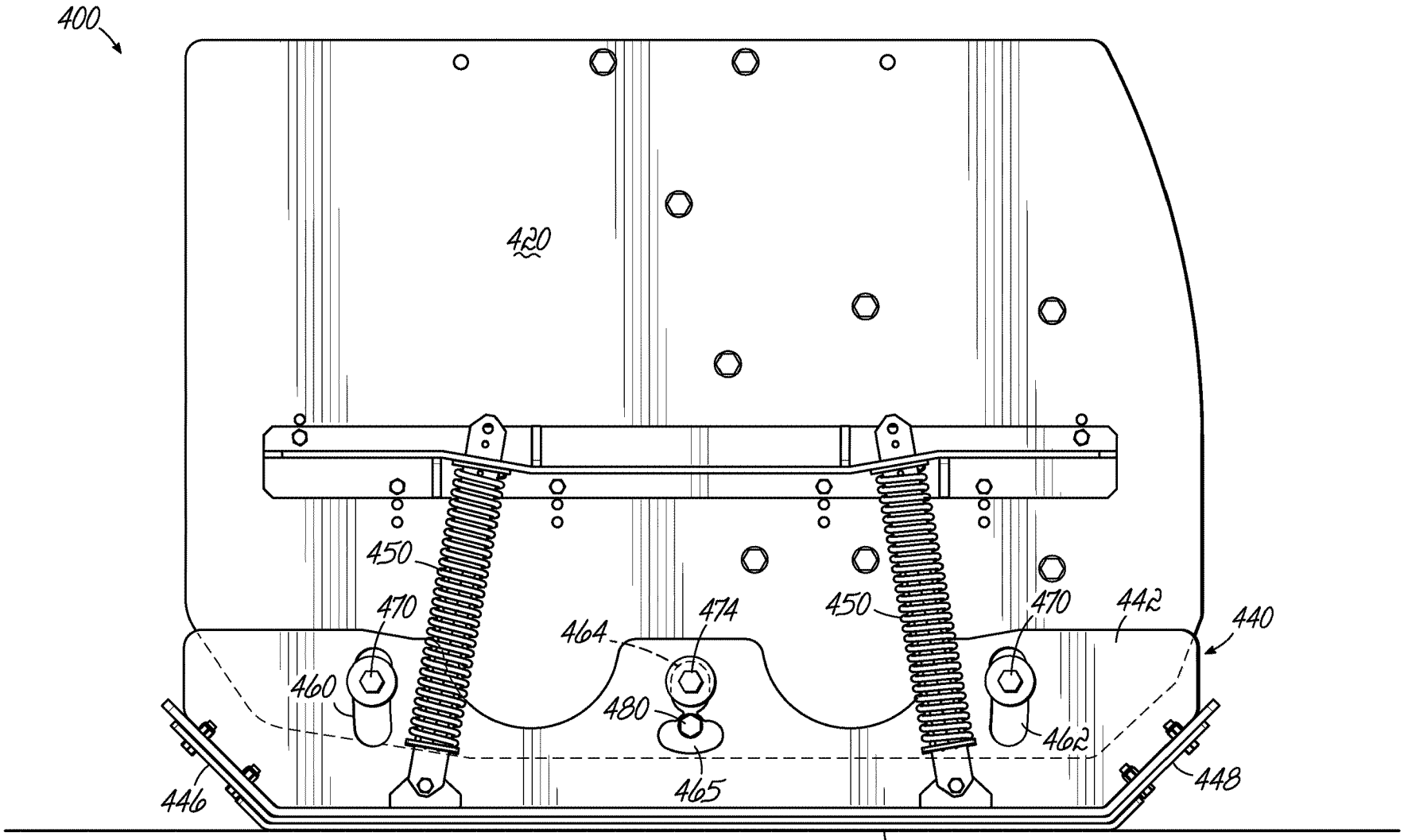
FIG. 26A is a left side view thereof with the shoe in the lower position.
Figure 26B:
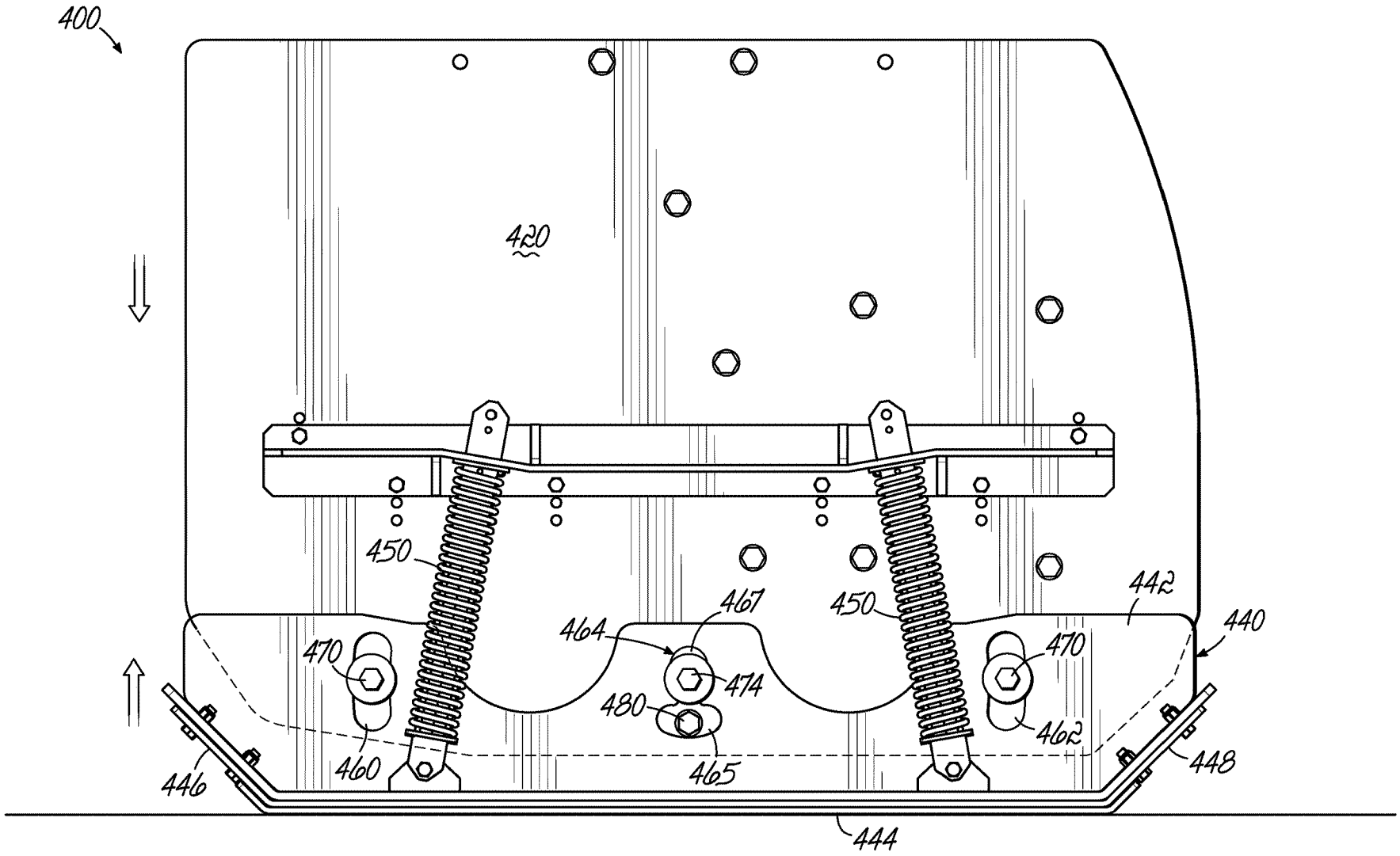
FIG. 26B is a view similar to FIG. 26A with the shoe in the upper position.
Figure 26C:
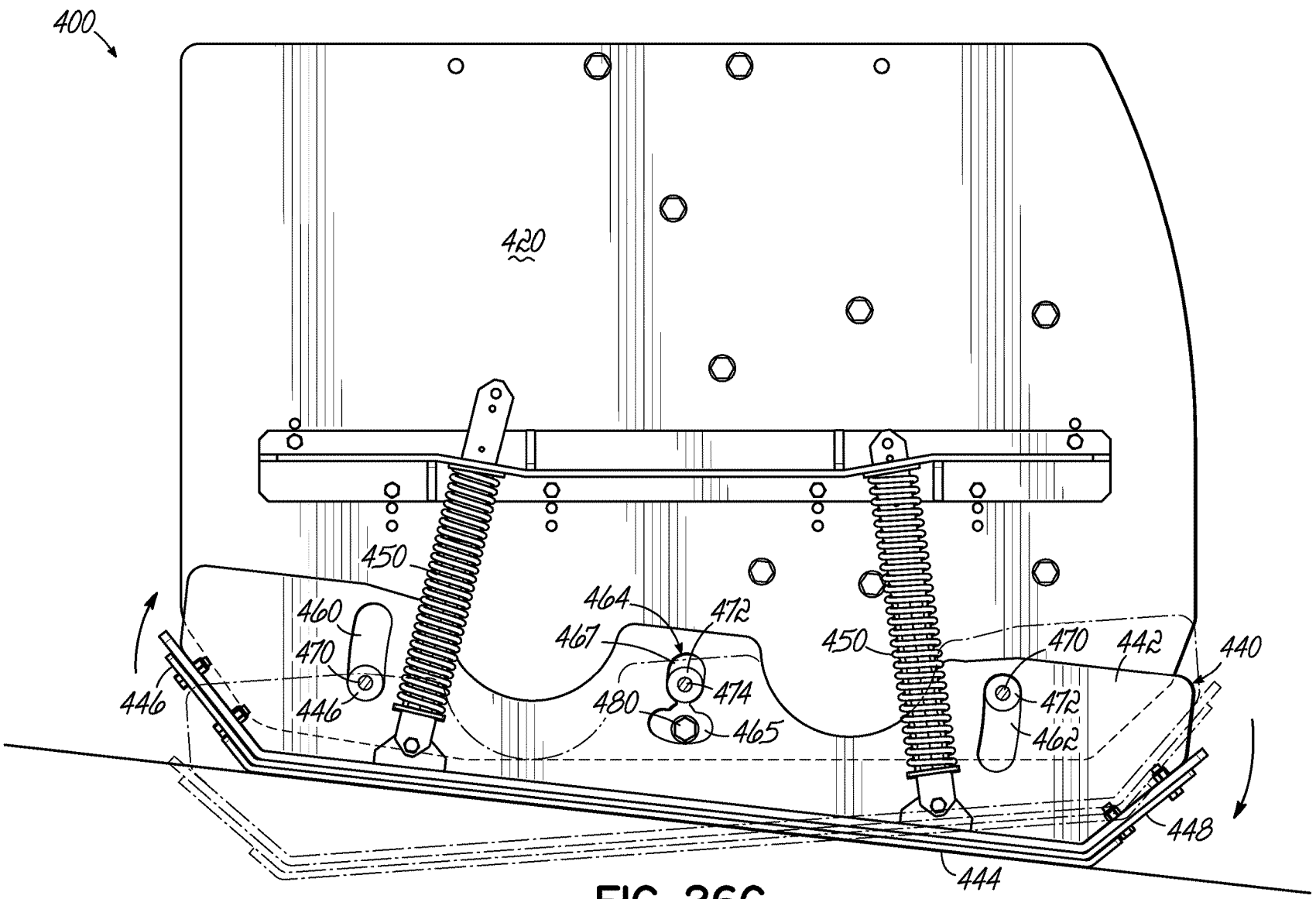
FIG. 26C is a view similar to FIGS. 26A and 26B with the front end of the shoe pivoted upward and the rear end of the shoe pivoted downward.

In FIG. 19B, surface irregularities have caused pivoting of cutting edge 134 such that the outboard most end of the cutting edge 134 has moved upward/downward, and the inboard most end of the cutting edge 134 has correspondingly moved downward/upward, as the case may be, as when encountering a surface irregularity such as a rise or a depression.

Referring now to FIGS. 21-28, and with like numbers representing like elements, an alternative embodiment of wing assembly in the form of a moldboard extension and wing assembly 400 is illustrated. Similar to moldboard frame 60, assembly 400 includes an extension frame 402, having upper 404 and lower 406 generally transverse, generally horizontal frame members. A pair of generally vertical ribs or plates 408, 410 are secured to frame members 404, 406. A pair of end plates 412, 414 are likewise secured to frame members 404, 406. A moldboard extension 416 is secured to the ribs 408, 410 and end plates 412, 414. Similar to moldboard 70, moldboard extension 416 includes a moldboard cutting edge segment subassembly 234. A wing 420 is connected to end plate 412 with fasteners, and the other end plate 414 is connected to the end plate 69 of the moldboard frame 60. Wing 420 is generally perpendicular to moldboard extension 416.

Thus, extension frame 402, having two frame members, two end plates, two ribs, a moldboard, and one cutting edge segment subassembly, is essentially a modular 2 foot wide ($W_1$ in FIG. 25) section constructed similar to main or central plow assembly 20. This modular section is usable with either pivoting wing 90 or fixed wing 420 attached thereto. Such an assembly is desirable for those wishing to extend the width (W in FIG. 25) of main plow assembly 20 by 4 feet to convert a 10 or 12 foot wide plow to 14 or 16 foot wide.

A shoe 440 is movably mounted to a lower edge of the wing 420 to permit vertical translational movement in a plane defined by the wing and pivoting movement about an axis generally perpendicular to the plane defined by the wing. The shoe 440 is generally L-shaped in cross-section, having a leg portion 442 and a foot portion 444. Portion 442 is mounted to wing 420. Portion 444 is a runner and has an upturned forward end 446 and an upturned rearward end 448. Shoe 440 is spring biases to a downward position via compression springs 450 acting between wing 420 and shoe 440.

Portion 442 includes a forward opening 460, a rearward opening 462, and a middle or central opening 464. Openings 460 and 462 are in the form of generally vertically oriented arcuate slots. Opening 464 is in the form of a generally vertically oriented upper slot 467 communicating with a generally horizontally oriented lower arcuate slot 465. Fasteners 470 pass through bushings 472 in slots 460, 462 and are threaded into threaded holes 463 in wing 420. A third central fastener 474 passes through a bushing 472 in upper slot 467 of opening 464 and is threaded into a threaded hole 463 in wing 420. A fourth fastener 480 is threaded into wing 420, the head of which resides in lower slot 465 of opening 464. Openings 460, 462, and 464 and fasteners 470, 474, and 480 permit vertical translational movement (FIGS. 26A and 26B) and pivoting movement (FIG. 26C) of shoe 440 within limits, with shoe 440 translating vertically relative to fasteners 470, 474, and 480, and pivoting relative to central fastener 474.

Figure 27:
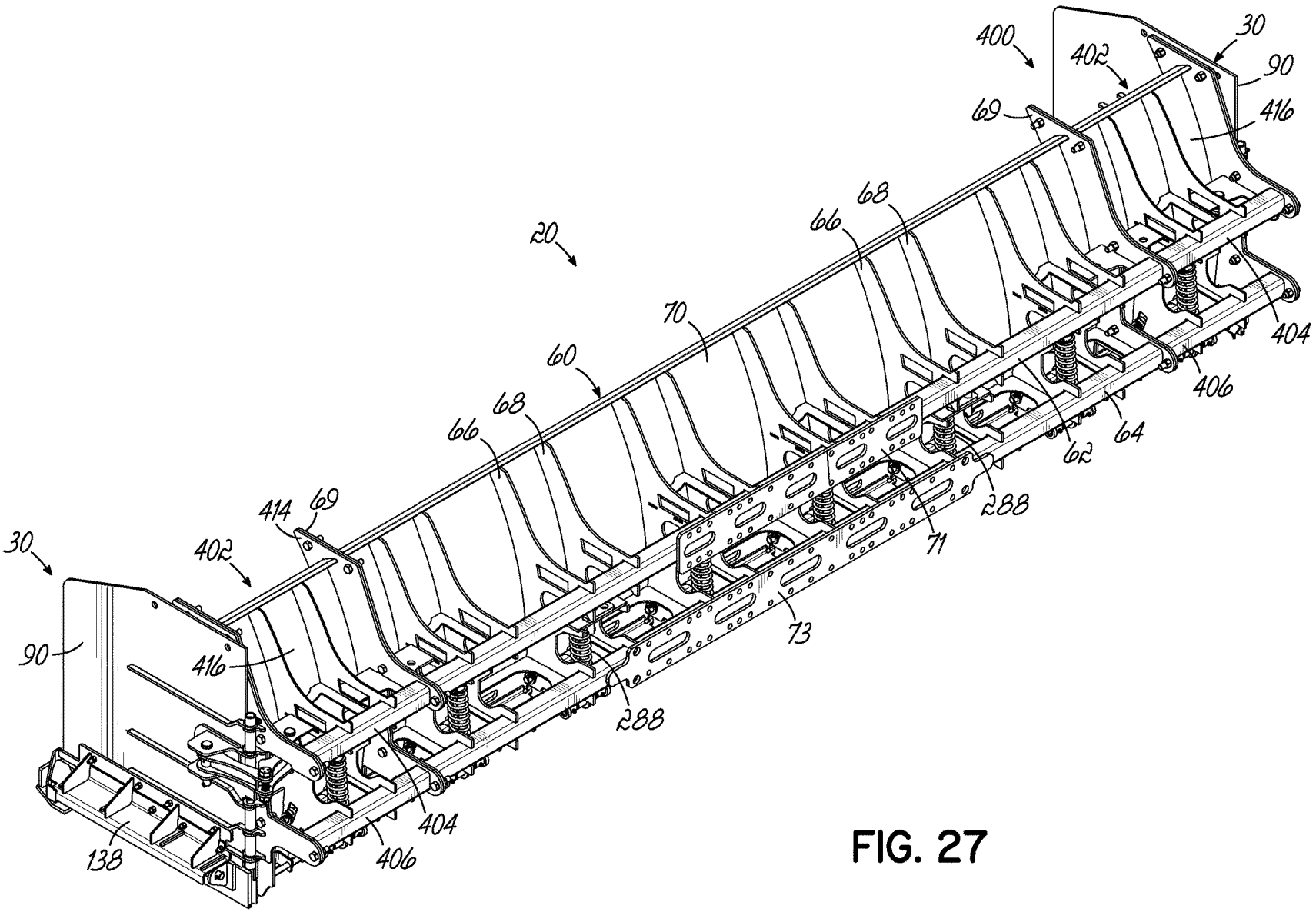
FIG. 27 is a rear, left, top view of the plow of another alternative embodiment of the plow with a moldboard extension assembly in combination with the pivoting wing assembly of FIGS. 1-19B.
Figure 28:
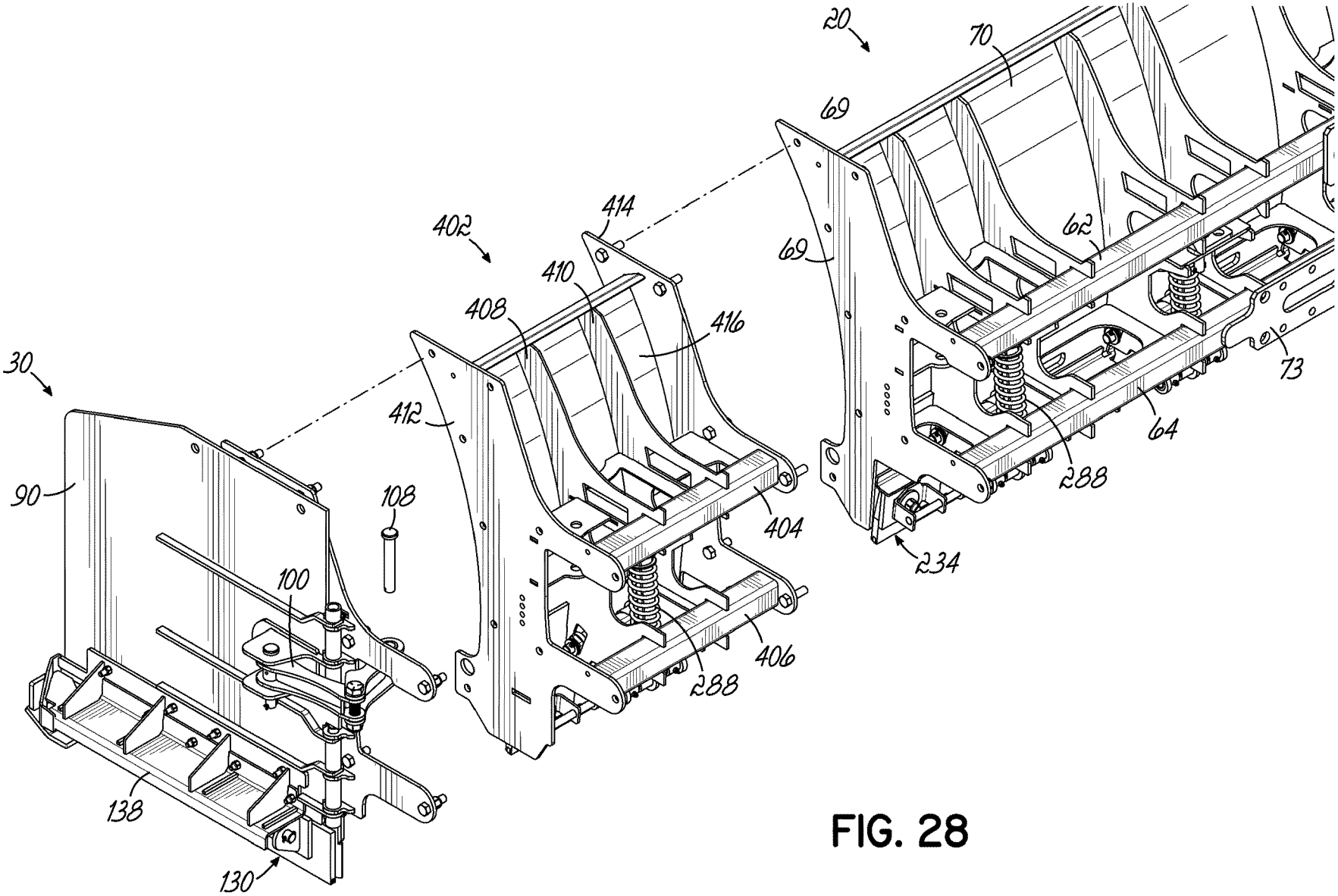
FIG. 28 is a rear, left, top exploded view of the left end of the plow of FIG. 27.

As mentioned, the modular 2 foot wide section comprising extension frame 402, moldboard extension 416, and cutting edge segment subassembly 234 can also be used in conjunction with pivoting wing 90, as shown in FIGS. 27 and 28.

While the various features of the main blade cutting edge and the wing blade cutting edge have particular application for use with containment plows mountable to skid steers, wheeled loaders, and tractors, it will be appreciated that those features also have application to other types of plows such as straight-blade plows and V-blade plows mountable to other vehicles, such as pickup trucks. Accordingly, the various embodiments of the invention described and claimed are not limited to containment plows and skid steers/wheeled loaders/tractors.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in any and all combinations and subcombinations of any and all of those features. Accordingly, the scope of the invention shall be limited only by the following claims and their equivalents.

What is claimed is:

1. A containment plow adapted to be mounted to a vehicle, comprising:

a moldboard frame, a moldboard mounted to said moldboard frame, a moldboard cutting edge mounted to a lower edge of said moldboard and comprising a plurality of cutting edge segments, each said moldboard cutting edge segment mounted so as to have two rotational degrees of freedom movement relative to said moldboard and one translational degree of freedom movement relative to said moldboard, and a moldboard extension and wing assembly connected to said moldboard frame adjacent each end of said moldboard, said assembly comprising:

an extension frame, a moldboard extension mounted to said extension frame, a wing connected to said extension frame at an outboard end of said moldboard extension, said moldboard extension having one of said cutting edge segments mounted to a lower edge of said moldboard extension, said moldboard extension cutting edge segment mounted so as to have two rotational degrees of freedom movement relative to said moldboard extension and one translational degree of freedom movement relative to said moldboard extension.

2. The plow of claim 1 wherein:

each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, and said moldboard extension cutting edge segment is mounted to permit 1) pivoting movement about said first axis generally parallel to said lower edge of said moldboard, 2) pivoting movement about said second axis generally perpendicular to said lower edge of said moldboard, and 3) translational movement generally parallel to said lower edge of said moldboard.

3. The plow of claim 2 wherein:

each said cutting edge segment is mounted to a respective cutting edge segment support plate, said support plate pivotally connected to said moldboard frame or said extension frame with a pivot pin, said pivot pin providing the pivoting movement of said segment about said first axis, each end of said pivot pin positioned in a slot in a rib of said moldboard frame or said extension frame, said slots providing the translational movement of said segment generally parallel to said lower edge of said moldboard, and wherein each said cutting edge segment is pivotally connected to said support plate with a fastener positioned medially of a length of said segment, said fastener providing the pivoting movement of said segment about said second axis.

4. The plow of claim 3 wherein a single biasing element biases said segment forward relative to said lower edge of said moldboard about said first axis and downward relative to said lower edge of said moldboard.

5. The plow of claim 1 wherein said moldboard has a width of about 10 feet or about 12 feet, and said assembly has a width of about 2 feet.

6. The plow of claim 1 wherein said wing is pivotally connected to said extension frame.

7. The plow of claim 1 wherein said wing is fixedly connected to said extension frame, is generally perpendicular to said moldboard extension, and has a shoe movably mounted to a lower edge thereof.

8. The plow of claim 7 wherein said shoe is mounted to permit 1) vertical translational movement in a plane defined by said wing, and 2) pivoting movement about an axis generally perpendicular to the plane defined by said wing.

9. The plow of claim 8 wherein said shoe is spring biased to a downward position.

10. The plow of claim 9 wherein said shoe is generally L-shaped in cross-section having a leg portion and a foot portion, and wherein said leg portion is mounted to said wing and said foot portion is a runner having an upturned forward end and an upturned rearward end.

11. The plow of claim 10 wherein said leg portion includes a forward opening, a rearward opening, and a middle opening, and a fastener passing through each opening and secured to said wing.

12. The plow of claim 11 wherein said forward and rearward openings are generally vertically oriented arcuate slots, and said middle opening is a generally vertically oriented upper slot and a generally horizontally oriented lower arcuate slot.

13. The plow of claim 12 wherein said fastener that passes through said middle opening is an upper fastener, said upper fastener passing through said upper slot, and further comprising a lower fastener passing through said lower slot, said upper and lower slots and upper and lower fasteners permitting vertical translational movement and pivoting movement of said shoe within limits.

14. A moldboard extension and wing assembly adapted to be connected to an end of a moldboard frame of a containment plow, the containment plow adapted to be mounted to a vehicle, said assembly comprising:

an extension frame, a moldboard extension mounted to said extension frame, a wing connected to one end of said extension frame, said moldboard extension having a cutting edge segment mounted to a lower edge of said moldboard extension, said cutting edge segment mounted so as to have two rotational degrees of freedom movement relative to said moldboard extension and one translational degree of freedom movement relative to said moldboard extension.

15. The assembly of claim 14 wherein:

said cutting edge segment is mounted to permit 1) pivoting movement about a first axis generally parallel to a lower edge of said moldboard extension, 2) pivoting movement about a second axis generally perpendicular to said lower edge of said moldboard extension, and 3) translational movement generally parallel to said lower edge of said moldboard extension.

16. The assembly of claim 15 wherein:

said cutting edge segment is mounted to a respective cutting edge segment support plate, said support plate pivotally connected to said extension frame with a pivot pin, said pivot pin providing the pivoting movement of said segment about said first axis, each end of said pivot pin positioned in a slot in a rib of said extension frame, said slots providing the translational movement of said segment generally parallel to said lower edge of said moldboard extension, and wherein said cutting edge segment is pivotally connected to said support plate with a fastener positioned medially of a length of said segment, said fastener providing the pivoting movement of said segment about said second axis.

17. The assembly of claim 16 wherein a single biasing element biases said segment forward relative to said lower edge of said moldboard extension about said first axis and downward relative to said lower edge of said moldboard extension.

18. The assembly of claim 14 wherein said assembly has a width of about 2 feet.

19. The assembly of claim 14 wherein said wing is pivotally connected to said extension.

20. The assembly of claim 14 wherein said wing is fixedly connected to said extension frame, is generally perpendicular to said moldboard extension, and has a shoe movably mounted to a lower edge thereof.

21. The assembly of claim 20 wherein said shoe is mounted to permit 1) vertical translational movement in a plane defined by said wing, and 2) pivoting movement about an axis generally perpendicular to the plane defined by said wing.

22. The assembly of claim 21 wherein said shoe is spring biased to a downward position.

23. The assembly of claim 22 wherein said shoe is generally L-shaped in cross-section having a leg portion and a foot portion, and wherein said leg portion is mounted to said wing and said foot portion is a runner having an upturned forward end and an upturned rearward end.

24. The assembly of claim 23 wherein said leg portion includes a forward opening, a rearward opening, and a middle opening, and a fastener passing through each opening and secured to said wing.

25. The assembly of claim 24 wherein said forward and rearward openings are generally vertically oriented arcuate slots, and said middle opening is a generally vertically oriented upper slot and a generally horizontally oriented lower arcuate slot.

26. The assembly of claim 25 wherein said fastener that passes through said middle opening is an upper fastener, said upper fastener passing through said upper slot, and further comprising a lower fastener passing through said lower slot, said upper and lower slots and upper and lower fasteners permitting vertical translational movement and pivoting movement of said shoe within limits.

27. A moldboard extension and wing assembly adapted to be connected to an end of a moldboard frame of a containment plow, the containment plow adapted to be mounted to a vehicle, said assembly comprising:

an extension frame, a moldboard extension mounted to said extension frame, a wing fixedly connected to one end of said extension frame and generally perpendicular to said moldboard extension, said moldboard extension having a cutting edge segment mounted to a lower edge of said moldboard extension, and a shoe movably mounted to a lower edge of said wing to permit 1) vertical translational movement in a plane defined by said wing, and 2) pivoting movement about an axis generally perpendicular to the plane defined by said wing.

28. The assembly of claim 27 wherein said assembly has a width of about 2 feet.

29. The assembly of claim 27 wherein said shoe is spring biased to a downward position.

30. The assembly of claim 29 wherein said shoe is generally L-shaped in cross-section having a leg portion and a foot portion, and wherein said leg portion is mounted to said wing and said foot portion is a runner having an upturned forward end and an upturned rearward end.

31. The assembly of claim 30 wherein said leg portion includes a forward opening, a rearward opening, and a middle opening, and a fastener passing through each opening and secured to said wing.

32. The assembly of claim 31 wherein said forward and rearward openings are generally vertically oriented arcuate slots, and said middle opening is a generally vertically oriented upper slot and a generally horizontally oriented lower arcuate slot.

33. The assembly of claim 32 wherein said fastener that passes through said middle opening is an upper fastener, said upper fastener passing through said upper slot, and further comprising a lower fastener passing through said lower slot, said upper and lower slots and upper and lower fasteners permitting vertical translational movement and pivoting movement of said shoe within limits.

* * * * *